US009290282B2

(12) United States Patent
Lancaster, III et al.

(10) Patent No.: US 9,290,282 B2
(45) Date of Patent: Mar. 22, 2016

(54) APPARATUS FOR SECURING A LOAD TO A PALLET WITH A ROPED FILM WEB

(71) Applicant: Lantech.com, LLC, Louisville, KY (US)

(72) Inventors: Patrick R. Lancaster, III, Louisville, KY (US); Donnie Norris, Pleasureville, KY (US); David E. Eldridge, Fern Creek, KY (US)

(73) Assignee: Lantech.com, LLC, Louisville, KY (US)

( * ) Notice: Subject to any disclaimer, the term of this patent is extended or adjusted under 35 U.S.C. 154(b) by 0 days.

(21) Appl. No.: 14/802,635

(22) Filed: Jul. 17, 2015

(65) Prior Publication Data

US 2015/0321774 A1 Nov. 12, 2015

Related U.S. Application Data

(62) Division of application No. 12/493,996, filed on Jun. 29, 2009, which is a division of application No. 10/767,863, filed on Jan. 30, 2004, now Pat. No. 7,568,327.

(60) Provisional application No. 60/500,221, filed on Sep. 5, 2003, provisional application No. 60/443,845, filed on Jan. 31, 2003.

(51) Int. Cl.
*B65B 11/00* (2006.01)
*B65B 11/02* (2006.01)
(Continued)

(52) U.S. Cl.
CPC ..... *B65B 11/006* (2013.01); *B65B 11/02* (2013.01); *B65B 11/025* (2013.01); *B65B 11/045* (2013.01); *B65B 41/16* (2013.01); *B65B 2210/20* (2013.01)

(58) Field of Classification Search
CPC ..... B65B 11/006; B65B 11/02; B65B 41/16; B65B 11/045; B65B 11/025; B65B 2210/18; B65B 2011/002
USPC ..... 53/556, 588, 559, 210, 441, 465
See application file for complete search history.

(56) References Cited

U.S. PATENT DOCUMENTS 4,152,879 A 5/1979 Shulman
4,216,640 A 8/1980 Kaufman
(Continued)

FOREIGN PATENT DOCUMENTS

DE 3634924 4/1988
EP 0096635 12/1983
(Continued)

OTHER PUBLICATIONS

European Patent Office International Search Report for PCT/US2004/000219 dated Jun. 21, 2004, pp. 1-7, Rijswijk, Netherlands.
(Continued)

*Primary Examiner* — Sameh Tawfik
(74) *Attorney, Agent, or Firm* — Middleton Reutlinger

(57) ABSTRACT

An apparatus and method for wrapping a palletized load are provided. The apparatus preferably includes a film dispenser for dispensing a film web, at least one guide rollers configured to engage the width of the film web, and at least one roping element. The at least one roping element may be a cable rolling roper configured to roll a portion of the film web into a rolled cable of film. The apparatus may also include means for providing relative rotation between the load and the dispenser to wrap a roped portion of the film web around a base of the load/top portion of a pallet supporting the load.

21 Claims, 21 Drawing Sheets

(51) Int. Cl.
*B65B 41/16* (2006.01)
*B65B 11/04* (2006.01)

(56) References Cited

U.S. PATENT DOCUMENTS

| | | | |
|---|---|---|---|
| 4,235,062 | A | 11/1980 | Lancaster, III et al. |
| 4,271,657 | A | 6/1981 | Lancaster et al. |
| 4,300,326 | A | 11/1981 | Stackhouse |
| 4,387,548 | A | 6/1983 | Lancaster et al. |
| 4,395,255 | A | 7/1983 | Branecky et al. |
| 4,418,510 | A | 12/1983 | Lancaster, III et al. |
| 4,432,185 | A | 2/1984 | Geisinger |
| 4,458,467 | A | 7/1984 | Shulman et al. |
| 4,501,105 | A | 2/1985 | Rogers et al. |
| 4,503,658 | A | 3/1985 | Mouser et al. |
| 4,514,955 | A | 5/1985 | Mouser et al. |
| 4,590,746 | A | 5/1986 | Humphrey |
| 4,676,048 | A | 6/1987 | Lancaster et al. |
| 4,693,049 | A | 9/1987 | Humphrey |
| 4,754,594 | A | 7/1988 | Lancaster |
| 4,761,934 | A | 8/1988 | Lancaster |
| 4,807,427 | A | 2/1989 | Casteel et al. |
| 4,840,006 | A | 6/1989 | Humphrey |
| 4,845,920 | A | 7/1989 | Lancaster |
| 4,905,451 | A | 3/1990 | Jaconelli et al. |
| 4,953,336 | A | 9/1990 | Lancaster, III et al. |
| 4,991,381 | A | 2/1991 | Simons |
| 5,040,356 | A | 8/1991 | Thimon |
| 5,040,359 | A | 8/1991 | Thimon et al. |
| 5,077,956 | A | 1/1992 | Thimon |
| 5,107,657 | A | 4/1992 | Diehl et al. |
| 5,186,981 | A | 2/1993 | Shellhamer et al. |
| 5,195,296 | A | 3/1993 | Matsumoto |
| 5,195,297 | A | 3/1993 | Lancaster et al. |
| 5,195,301 | A | 3/1993 | Martin-Cocher et al. |
| 5,203,136 | A | 4/1993 | Thimon et al. |
| 5,203,139 | A | 4/1993 | Salsburg et al. |
| 5,216,871 | A | 6/1993 | Hannen |
| 5,240,198 | A | 8/1993 | Dorfel |
| 5,301,493 | A | 4/1994 | Chen |
| 5,311,725 | A | 5/1994 | Martin et al. |
| 5,414,979 | A | 5/1995 | Moore et al. |
| 5,447,008 | A | 9/1995 | Martin-Cocher |
| 5,450,711 | A | 9/1995 | Martin-Cocher |
| 5,463,842 | A | 11/1995 | Lancaster |
| 5,463,843 | A | 11/1995 | Sharp |
| 5,572,855 | A | 11/1996 | Reigrut et al. |
| 5,765,344 | A | 6/1998 | Mandeville et al. |
| 5,799,471 | A | 9/1998 | Chen |
| 5,836,140 | A | 11/1998 | Lancaster, III |
| 5,875,617 | A | 3/1999 | Scherer |
| 5,884,453 | A | 3/1999 | Ramsey et al. |
| 5,953,888 | A | 9/1999 | Martin-Cocher et al. |
| 6,082,081 | A | 7/2000 | Mucha |
| 6,195,968 | B1 | 3/2001 | Marois et al. |
| 6,253,532 | B1 | 7/2001 | Orpen |
| 6,293,074 | B1 | 9/2001 | Lancaster, III et al. |
| 6,360,512 | B1 | 3/2002 | Marois et al. |
| 6,453,643 | B1 | 9/2002 | Buscherini et al. |
| 6,748,718 | B2 | 6/2004 | Lancaster, III et al. |
| 6,826,893 | B2 | 12/2004 | Cere |
| 6,851,252 | B2 | 2/2005 | Maki-Rahkola et al. |
| 7,540,128 | B2 | 6/2009 | Lancaster, III et al. |
| 7,568,327 | B2 | 8/2009 | Lancaster, III et al. |
| 2003/0110737 | A1 | 6/2003 | Lancaster, III et al. |
| 2003/0145563 | A1 | 8/2003 | Cere |
| 2005/0044812 | A1 | 3/2005 | Lancaster, III et al. |
| 2006/0213155 | A1 | 9/2006 | Forni et al. |
| 2006/0248858 | A1 | 11/2006 | Lancaster, III et al. |
| 2006/0254225 | A1 | 11/2006 | Lancaster, III et al. |
| 2006/0289691 | A1 | 12/2006 | Forni |
| 2007/0204564 | A1 | 9/2007 | Lancaster, III et al. |
| 2007/0204565 | A1 | 9/2007 | Lancaster, III et al. |
| 2007/0209324 | A1 | 9/2007 | Lancaster, III et al. |

FOREIGN PATENT DOCUMENTS

| | | | |
|---|---|---|---|
| EP | 0466980 | | 1/1992 |
| EP | 0811554 | | 12/1997 |
| EP | 1213223 | | 6/2002 |
| EP | 1705119 | A1 | 9/2006 |
| EP | 1717149 | A1 | 11/2006 |
| EP | 1736426 | A2 | 12/2006 |
| EP | 1736426 | A3 | 10/2007 |
| GB | 2107668 | | 5/1983 |
| WO | 9822346 | | 5/1998 |
| WO | 2004069659 | | 8/2004 |
| WO | 2006110596 | | 10/2006 |
| WO | 2007071593 | | 6/2007 |
| WO | 2007100597 | | 9/2007 |
| WO | 2008007189 | | 1/2008 |

OTHER PUBLICATIONS

European Patent Office International Search Report for PCT/US2006/013178 dated Aug. 14, 2006, pp. 1-7, Munich, Germany.
European Patent Office International Search Report for PCT/US2007/004581 dated Feb. 5, 2008, pp. 1-9, Munich, Germany.
European Patent Office International Search Report for PCT/US2007/004588 dated Aug. 27, 2007, pp. 1-6, Munich, Germany.
European Patent Office International Search Report for PCT/US2007/004589 dated Sep. 9, 2007, pp. 1-10, Munich, Germany.
Australian Patent Office, Office Action for 2010203127 dated May 4, 2012.

PRIOR ART

APPARATUS FOR SECURING A LOAD TO A PALLET WITH A ROPED FILM WEB

DESCRIPTION OF THE INVENTION

1. Field of the Invention

The present invention relates to wrapping a bottom portion of a palletized load with a rope of packaging material. The present invention also relates to rolling a portion of a packaging material web into a cable to be wrapped around a load. The present invention further relates to wrapping a palletized load with packaging material, and more particularly, securing a bottom portion of the wrapped load, in contact with a pallet, with the rolled cable of packaging material.

2. Background of the Invention

Various packaging techniques have been used to build a load of unit products and subsequently wrap them for transportation, storage, containment and stabilization, protection and waterproofing. Products are often stacked as a load on a pallet to simplify handling of the products. The pallet load is commonly wrapped with stretch wrap packaging material. One system uses stretch wrapping machines to stretch, dispense and wrap stretch packaging material around a load. Stretch wrapping can be performed as an inline, automated packaging technique that dispenses and wraps packaging material in a stretch condition around a load on a pallet to cover and contain the load. Pallet stretch wrapping, whether accomplished by a turntable, rotating arm, or vertical rotating ring, typically covers the four vertical sides of the load with a stretchable film such as polyethylene film. In each of these arrangements, relative rotation is provided between the load and the packaging material dispenser to wrap packaging material about the sides of the load.

Stretch wrapping machines provide relative rotation between a stretch wrap packaging dispenser and a load either by driving the stretch wrap packaging dispenser around a stationary load or rotating the load on a turntable. Upon relative rotation, packaging material is wrapped on the load. Ring style stretch wrappers generally include a roll of packaging material mounted in a dispenser that rotates about the load on a ring. Vertical rings move vertically between an upper and lower position to wrap film around a load. In a vertical ring, as in turntable and rotating wrap arm apparatuses, the four vertical sides of the load are wrapped, along the height of the load.

When pallet loads are wrapped, it is beneficial to wrap the film around the base of the load and at least a top portion of the pallet supporting the load in order to secure the load to the pallet. If the film is not wrapped around enough of the pallet, shifting of the load may occur during transportation of the load. In addition, it is also desirable to rope or gather the film at the base of the film web before applying it to the base of the load and the top portion of the pallet to provide additional resistance to load shifting. In order to gather the film web into a rope at the base of the load and wrap the base of the load and the pallet, the packaging material must be dispensed at a level below the base of the load.

In general, film delivery systems support the roll of film a couple of inches above the base of the film dispensing unit. As shown in FIG. 1, the bottom edge of the film web 12 is generally one to two inches above the bottom of the delivery system 2. In addition, the web of film 12 typically necks down one to two inches on both the top and bottom edges of the film. In addition, one to two inches of clearance are required between the base of the delivery system 2 and a load support surface (e.g., pedestal, conveyor, or floor). Thus, in conventional dispensers, the lower edge of the film web is typically six to seven inches above the base of the pallet. Since most pallets are five to eight inches tall, most loads do not have much, if any, film on the pallet. The "rope" of film is beneficial when wrapped around the pallet, securing the web of film to the pallet and the load to the pallet with the remainder of the non-roped film web.

To dispense the film web and create a "rope" at a level below the base of the load, the dispensing system must be lowered sufficiently below the load such that the base of the roll of film to be dispensed is below the base of the load. Certain types of wrapping apparatus, such as conventional turntable style machines, support the palletized load well above floor level, thereby providing sufficient clearance to lower the film delivery system, including the base of the roll of film, below the base of the load so that the film can be applied to the pallet and the base of the load.

Other types of machines, such as overhead machines and low profile turntable machines, do not provide the clearance necessary to lower the film delivery system below the base of the load. In overhead machines, the rotating arm that supports the film dispenser must be able to clear the load support surface (e.g., pedestal, conveyor, or floor). In low profile machines, the top of the rotatable turntable is only a couple of inches above the floor, and there is not enough clearance for the dispenser system, including the base of the roll of film, to be lowered below the level of the base of the load. In machines such as these, it is necessary to drive the film web and the rope of film to a level below the top of the pallet supporting the load.

Various techniques have been used in overhead machines in attempts to overcome this problem. Some prior art devices have tilted the dispensing system and others have tilted one or more idle rollers. See, for example, U.S. Pat. No. 5,875,617. Tilting the dispensing system and/or idle rollers has had limited success in working the film downward onto the pallet. Tilted roller concepts have had marginal success only, due to the sensitive nature of the tracking technique. For example, if the roller is tilted too far, the film collapses into a total rope, and if the roller is not tilted far enough, the film does not move downward enough to sufficiently cover the pallet. In addition, variation in film surface, temperature, and wrap force make it difficult to maintain an angle that will lower the film sufficiently without narrowing the web so much that many additional layers of wrap are required, decreasing wrap efficiency and increasing wrap cycle cost.

Angled bars have also been used in an attempt to guide the film to a level below the base of the load. See, for example, U.S. Pat. No. 5,077,956. This technique has had little success due to the high forces incurred during stretch wrapping. The resultant friction is problematic in maintaining a constant wrap force and consistent film guiding. Without complex and costly film feed force controls, friction build-up due to the tilted bars would break the film when added to the friction normally experienced during stretch wrapping.

Other prior art techniques include "dropping down" a conveyor around a palletized load to leave the palletized load on a pedestal, providing sufficient clearance to lower the film dispensing system, including the bottom of the film roll, below the level of the base of the load. Alternatively, some conveyor designs "pop up" the palletized load, raising it sufficiently above the conveyor to provide clearance for lowering the film dispensing system, including the base of the film roll, below the level of the base of the load. These are complex mechanical systems that are costly to maintain.

Conventionally, a "rope" of film is created when the base or bottom portion of the film web is moved over a roping mechanism, such as a wheel or fixed horizontal bar. The roping mechanism pushes the base or bottom portion of the film web upward into the film web, gathering the film web into a structure commonly referred to as a "rope." As discussed above, the rope may be wrapped around the base of the load to secure the film web layers to the load, thereby improving load containment. In conventional "ropes," the bottom portion of the film web is gathered, i.e., pushed together in accordion-like fashion, by a roping mechanism. Only the film web's tackiness holds the rope together; a conventional rope does not have any structural integrity. Thus, it is common for portions of a conventional rope of film to come undone or loosen during or after the wrapping process. For this reason, there is a need for a rope structure that is capable of retaining its structural integrity during the wrapping process and after the wrapping process, when the load is subject to various forces during shipping.

SUMMARY OF THE INVENTION

In accordance with the invention, a method and apparatus for securing a load to a pallet are provided. The method and apparatus guide the film web to an elevation that permits securing of a top portion of the pallet to the bottom of the load. The method and apparatus also tightly roll a portion of the film web into a film cable to be wrapped around a portion of the load and/or pallet.

According to one aspect of the present invention, an apparatus for wrapping a load is provided. The apparatus comprises a dispenser for dispensing a film web, means for rolling a portion of the film web into a cable, and means for providing relative rotation between the load and the dispenser to wrap the film web around the load.

According to another aspect of the present invention, an apparatus for wrapping a load comprises a dispenser for dispensing a film web, at least one guide roller, and a cable rolling roper configured to roll a portion of the film web into a cable, the roper being positioned adjacent to the at least one guide roller.

According to a further aspect of the present invention, an apparatus for wrapping a load comprises a dispenser for dispensing a film web, a first guide roller configured to engage at least a portion of a width of the film web, at least one roping element, and a second guide roller configured to engage at least a portion of the width of the film web, the second guide roller being selectively movable between an engaged position and an unengaged position.

According to yet another aspect of the present invention, an apparatus for wrapping a load includes a dispenser for dispensing a film web, at least one roping element, and means for driving at least a portion of the film web to an elevation below a top of a pallet supporting the load, the means for driving the film web including at least one selectively engageable roller positionable to engage a width of the film web.

According to another aspect of the present invention, an apparatus for wrapping a load comprises a dispenser for dispensing a film web, means for driving a portion of the film web to an elevation below a top of a pallet supporting the load, at least one roping element, and means for biasing a portion of the film web to narrow its width.

According to one aspect of the present invention, a method for wrapping a load is provided. The method comprises dispensing a film web from a film dispenser, rolling a portion of the film web into a cable, and providing relative rotation between the load and the dispenser to wrap the film web around the load.

According to another aspect of the present invention, a method for securing a load to a pallet with a film web is provided. The method comprises dispensing a film web from a dispenser, and rolling a portion of the film web into a rolled cable, wherein rolling a portion of the film web includes engaging a width of the film web with a guide roller and engaging at least an edge portion of the film web with a cable rolling roper positioned adjacent to the guide roller.

According to yet another aspect of the invention, a method for securing a load to a pallet with a film web comprises dispensing a film web from a dispenser, engaging a portion of the film web with a roping element, and driving a portion of the film web downward to an elevation below a top of a pallet supporting the load.

According to a further aspect of the present invention, a method for securing a load to a pallet with a film web comprises dispensing a film web from a dispenser, driving a portion of the film web downward to a first elevation below a film dispensing elevation, roping a portion of the film web into a rope of film, and driving the portion of the film web and cable downward to a second elevation below the film dispensing elevation.

According to another aspect of the present invention, a method for securing a load to a pallet with a film web comprises dispensing a film web from a dispenser, roping a portion of the film web into a roped portion, and biasing a portion of the film web to narrow its width.

According to yet another aspect of the present invention, a method for securing a load to a pallet with a film web includes dispensing a film web from a dispenser, engaging at least a portion of a width of the film web with at least one roller at a first elevation, disengaging the film web from the at least one roller at a second elevation, wherein the second elevation is lower than the first elevation, roping a portion of the film web into roped portion, and providing relative rotation between the load and the dispenser to secure the load to the pallet with the film web and cable.

According to another aspect of the present invention, a method for securing a load to a pallet with a film web comprises dispensing a film web from a dispenser, engaging at least a portion of a width of the film web with at least one roller at a first elevation, disengaging the film web from the at least one roller at a second elevation, wherein the second elevation is lower than the first elevation, roping a portion of the film web into roped portion, and providing relative rotation between the load and the dispenser to secure the load to the pallet with the film web and cable.

According to yet another aspect of the present invention, a method of securing a load to a pallet with a film web comprises dispensing a film web from a film dispenser, driving the film web to an elevation below a top of a pallet supporting the load, rolling a portion of the film web into a cable, and wrapping the cable around the pallet to secure the load to the pallet with the film web.

According to one aspect of the present invention, an apparatus for securing a load to a pallet with a film web is provided. The apparatus comprises a dispenser for dispensing a film web, means for driving the film web to an elevation below a top of the pallet supporting the load, the means for driving including at least one roller selectively positionable to engage a width of the film web, means for roping a portion of the film web into a rope, and means for providing relative rotation between the load and the dispenser.

According to another aspect of the invention, an apparatus for securing a load to a pallet with a film web includes a dispenser for dispensing a film web, means for driving the film web to an elevation below a top of the pallet supporting the load, the means for driving including at least one selectively engageable roller, the roller being angled relative to a film feed direction, at least one roping element, and means for providing relative rotation between the load and the dispenser.

According to a further aspect of the present invention, an apparatus for securing a load to a pallet with a film web comprises a dispenser for dispensing a film web, means for driving the film web to an elevation below a top of the pallet supporting the load, the means for driving including a first roller angled with respect to a film feed direction and a second roller angled with respect to the film feed direction, wherein the first and second rollers are tilted in substantially opposite directions, at least one roping element, and means for providing relative rotation between the load and the dispenser.

According to yet another aspect of the invention, an apparatus for wrapping a load is provided. The apparatus comprises a dispenser for dispensing a film web, a first roller angled to engage a film path between the dispenser and the load, a second roller selectively engagable with the film path, means for rolling a portion of the film web into a cable, and means for providing relative rotation between the load and the dispenser.

According to another aspect of the present invention, a method of wrapping a load comprises dispensing a film web from a dispenser, selectively engaging at least a portion of a width of the film web with a roller angled with respect to a film feed direction, driving at least a portion of the film web to an elevation below a top of the pallet supporting the load, rolling a portion of the film web into a cable, and providing relative rotation between the dispenser and the load to wrap the film web and cable around at least a portion of the load and pallet.

According to another aspect of the present invention, a method for securing a load to a pallet with a film web includes dispensing a film web from a dispenser, moving a roller into engagement with a film path between the dispenser and the load, wherein the roller is angled with respect to a film feed direction, moving the roller out of engagement with the film path, rolling a portion of the film web into a cable, and providing relative rotation between the dispenser and the load to wrap the load and at least a top portion of the pallet with the film web and cable.

According to a further aspect of the present invention, a method for wrapping a load includes dispensing a film web from a dispenser, engaging a selectively engageable roller at a first elevation with the film web, removing the film web from the selectively engageable roller at a second elevation that is lower than the first elevation, roping a portion of the film web into a rope, and providing relative rotation between the dispenser and the load to wrap at least a bottom portion of the load and at least a top portion of the pallet with the film web and rope.

According to yet another aspect of the present invention, an apparatus for wrapping a load includes a dispenser for dispensing a film web, means for biasing the film web to reduce its width, the means for biasing including a tilted roller, means for rolling a portion of the film web into a cable, and means for providing relative rotation between the dispenser and the load to wrap the cable and at least a portion of the film web around a top portion of the pallet and a bottom portion of the load.

According to another aspect of the present invention, an apparatus for wrapping a load comprises a dispenser for dispensing a film web, means for driving a portion of the film web to an elevation below a top of a pallet supporting the load, the means for driving including a first guide roller, means for biasing the film web to reduce its width, the means for biasing including a second guide roller, means for roping a portion of the film web, the means for roping including at least one roping element configured to engage an edge portion of the film web, and means for providing relative rotation between the dispenser and the load to wrap the roped film and at least a portion of the biased film web around a top portion of the pallet and a bottom portion of the load.

According to another aspect of the present invention, a method for securing a load to a pallet with a film web comprises dispensing a film web from a dispenser, engaging a width of the film web with a first guide roller to drive the film web to an elevation below a top of a pallet supporting the load, engaging at least a portion of the width of the film web with a second guide roller to bias the film web to reduce its width, engaging an edge portion of the film web with a roping element to rope a portion of the film web, and providing relative rotation between the dispenser and the load to wrap the cable and at least a portion of the biased film web around a top portion of the pallet and a bottom portion of the load.

According to a further aspect of the present invention, a wrapping apparatus for wrapping a palletized load includes a dispenser for dispensing a film web, film driving means for driving the film web to an elevation below a top of the pallet supporting the load, the film driving means including at least one roller selectively positionable to engage a width of the film web, and means for providing relative rotation between the load and the dispenser.

According to yet another aspect of the present invention, a wrapping apparatus for wrapping a palletized load comprises a dispenser for dispensing a film web, at least one bar tilted to selectively engage a film path between the dispenser and the load, the at least one bar being connected to a mechanical link, wherein the at least one bar is actuatable by engagement of the link with the dispenser, and means for providing relative rotation between the load and the dispenser.

According to another aspect of the present invention, an apparatus for wrapping a load comprises a dispenser for dispensing a film web, a cable rolling roper configured to engage an edge of the film web and roll it into a rolled cable of film, and means for providing relative rotation between the load and the dispenser to wrap the film web around the load.

Additional objects and advantages of the invention will be set forth in part in the description that follows, and in part will be obvious from the description, or may be learned by practice of the invention. The objects and advantages of the invention will be realized and attained by means of the elements and combinations particularly pointed out in the appended claims.

It is to be understood that both the foregoing general description and the following detailed description are exemplary and explanatory only and are not restrictive of the invention, as claimed.

The accompanying drawings, which are incorporated in and constitute a part of this specification, illustrates several embodiments of the invention and together with the description, serve to explain the principles of the invention.

DESCRIPTION OF THE EMBODIMENTS

Figure 1:
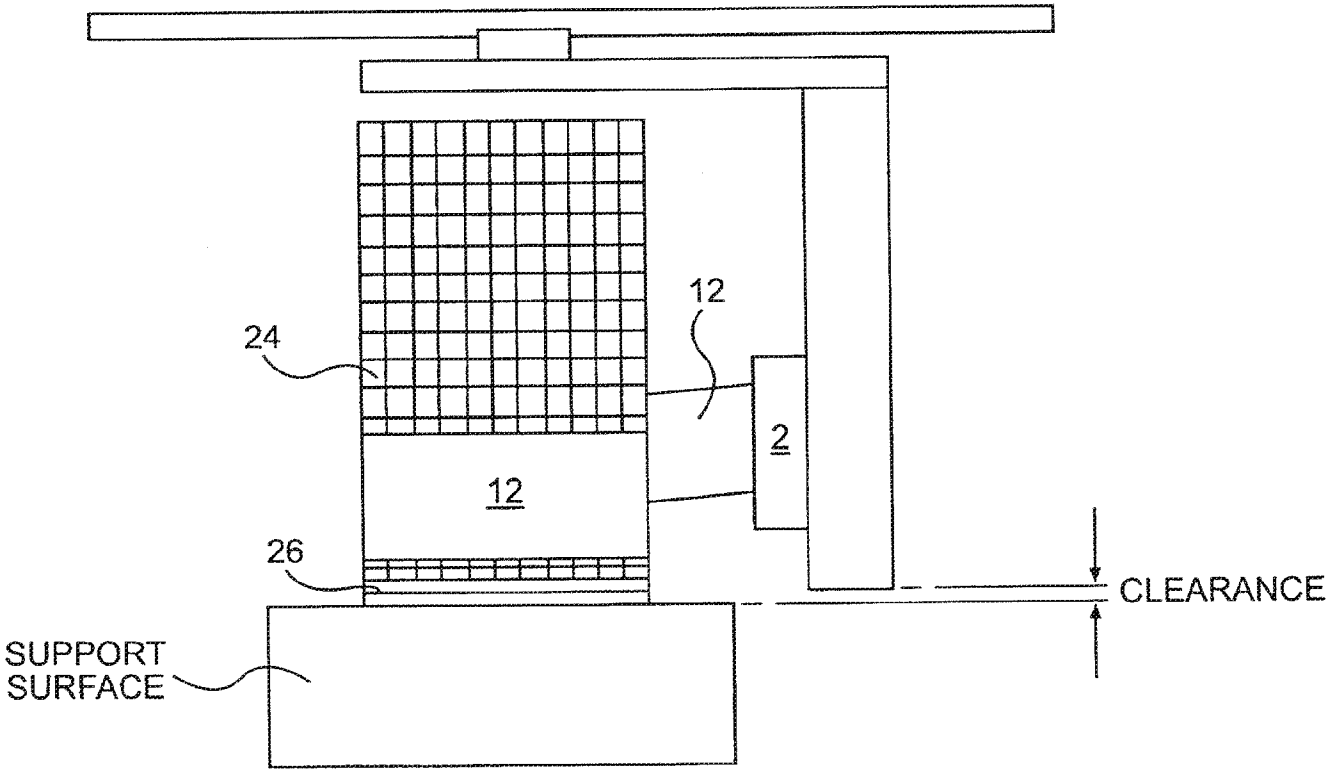
FIG. 1 is a side view of a conventional wrapping apparatus.

Reference will now be made in detail to the present embodiment of the invention, examples of which are illustrated in the accompanying drawings. Wherever possible, the same reference numbers will be used throughout the drawings to refer to the same or like parts.

The apparatus and method of the present invention guide the film web pulled off a film roll to a position such that a bottom portion of the film web is at an elevation below a top portion of a pallet supporting the load. This permits the base of the load and the top of the pallet to be wrapped with the film, better securing the load to the pallet and reducing the potential for load shifting during transport. At least a part of the bottom portion of the film web positioned below the top of the pallet forms a rope-like structure. The rope of film is wrapped around the pallet. The rope of film is a portion of the web of film that is concentrated in a tightly compacted, and preferably somewhat round, shape. The rope of film may be a conventional rope of film, which is gathered, compacted or compressed, or a rolled cable of film, which is described below.

The present invention provides a method and an apparatus for creating a rolled rope of film that is capable of maintaining its structural integrity as a rope structure during and after wrapping. The apparatus and method of the present invention roll an outer edge of the film web inward upon itself and toward the center of the film web. The film is rolled upon itself to form a tightly rolled cable of film. As used herein, the term "roll" means to wrap the film web round and round upon itself, for example, in the manner a poster is rolled up. The rolled cable of film has a preferred cross-section as shown in FIG. 2C. Thus, for example, the bottom edge of the film web may be rolled upward toward the center of the film web to form the rolled cable of film, or the top edge of the film web may be rolled downward toward the center of the film web to form the rolled cable of film. The film rolls tightly against itself, forming a high tensile cable. It is possible, however, that a small portion of the edge of the film web is gathered together prior to the film rolling up on itself. Preferably, the rolled cable includes three to five inches of the film from the film web.

The conventional rope of film is substantially stronger than the web of film. A rolled cable of film is also substantially stronger than the web of film and in comparison to the conventional rope of film, has the added benefit of structural integrity. The conventional rope and the rolled cable of film, when wrapped around the pallet, serve to anchor the web of film wrapped around the load and the pallet in substantially the same manner as a piece of wire wrapped around the pallet and over the film. This serves to prevent the film wrapped around the load from being pulled up and away from the pallet.

Because the conventional rope or rolled cable of film is wrapped around the pallet and not the load, it is possible to apply the rope or rolled cable at a higher wrap force. The conventional rope is less susceptible to damage than non-roped film, and the rolled cable is less susceptible to damage than the conventional rope of film. Use of either the conventional rope of film or the rolled cable of film thus makes the wrapping of the load more robust. That is, the wrapping is better able to withstand forces applied to it if it rubs against the pallet, or if the pallet rubs against another structure during shipping, such as a side of a truck or another pallet.

In addition, both the conventional rope and the rolled cable of film have the benefit of exerting a reactive force against anything pulling on it. For example, if something pulls the rope or cable away from the load on one side of the load, the load will not automatically shift because the rope or rolled cable on the other side of the pallet will pull back, reacting to the force and counteracting the force to stabilize the load.

Inventors' testing has shown that use of the film web with a rolled cable of film on a bottom portion of the film web provided superior results over standard film wrapping. Loads wrapped with the rolled cable around the top of the pallet, above the fork holes, were tilted with the pallet or lifted "off" the pallet. In each case, the film web maintained contact between the load and the pallet.

In accordance with the present invention, a method and apparatus are provided for wrapping a load with a packaging material. As shown in FIGS. 2A, 2B, 2D, 5A, 5B, and 7A-7D, an apparatus 100 for wrapping a load with packaging material includes a packaging material dispenser, an upstream guide roller, a downstream guide roller, a roping element, and means for providing relative rotation between the packaging material dispenser and the load.

Figure 2A:
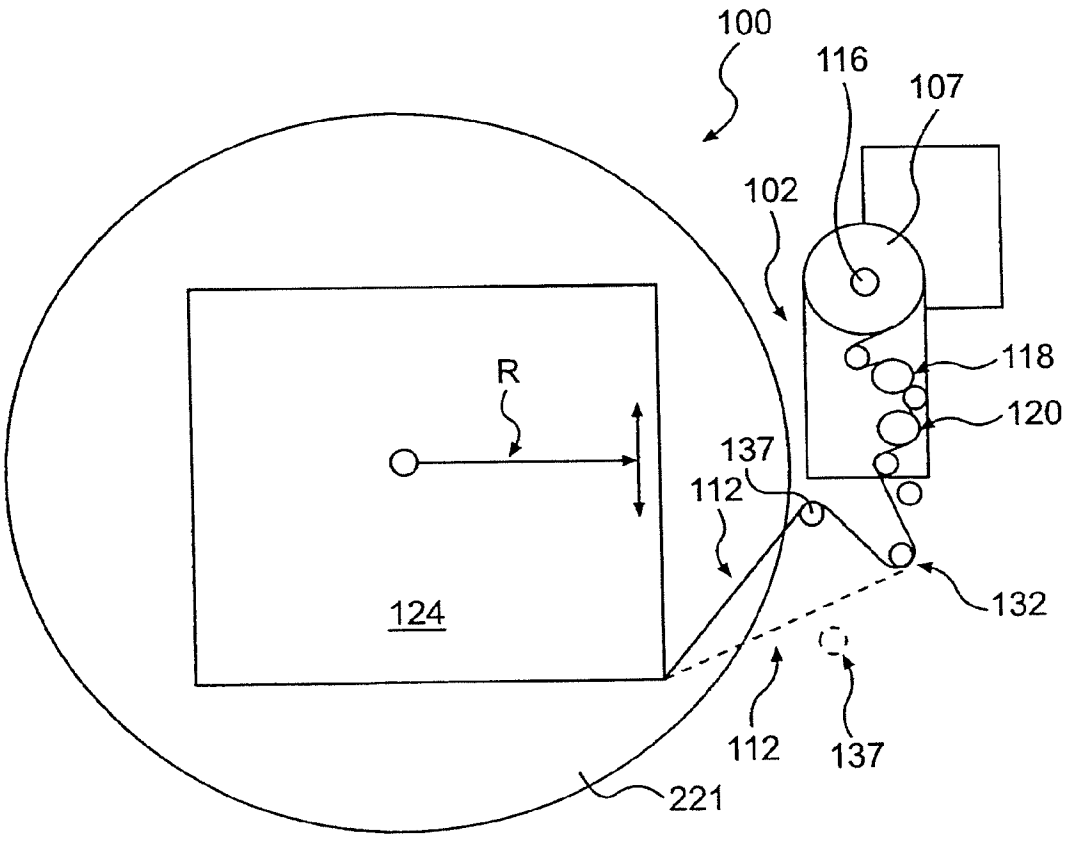
FIG. 2A is a top view of a wrapping apparatus having a cable rolling portion, according to one aspect of the invention.
Figure 2B:
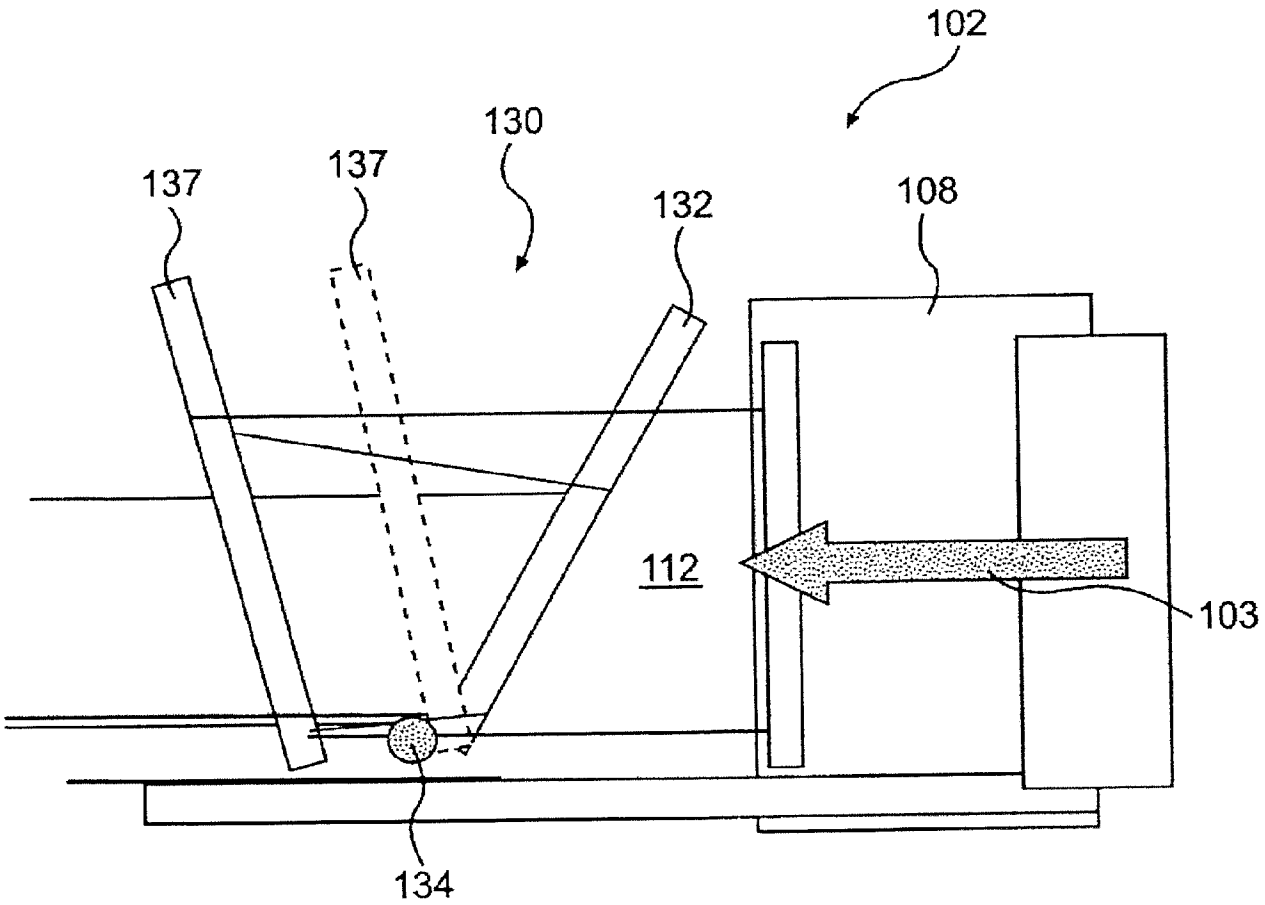
FIG. 2B is a side view of a portion of a dispenser and cable rolling portion of a wrapping apparatus, according to one aspect of the invention.
Figure 2C:
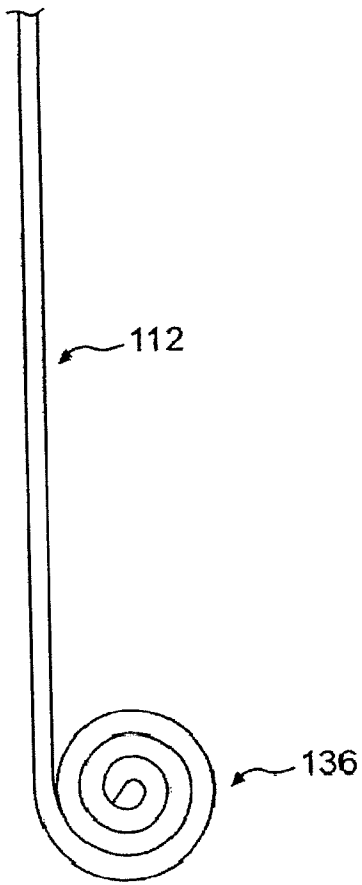
FIG. 2C is a cross-sectional view of a rolled cable of film, according to one aspect of the invention.
Figure 2D:
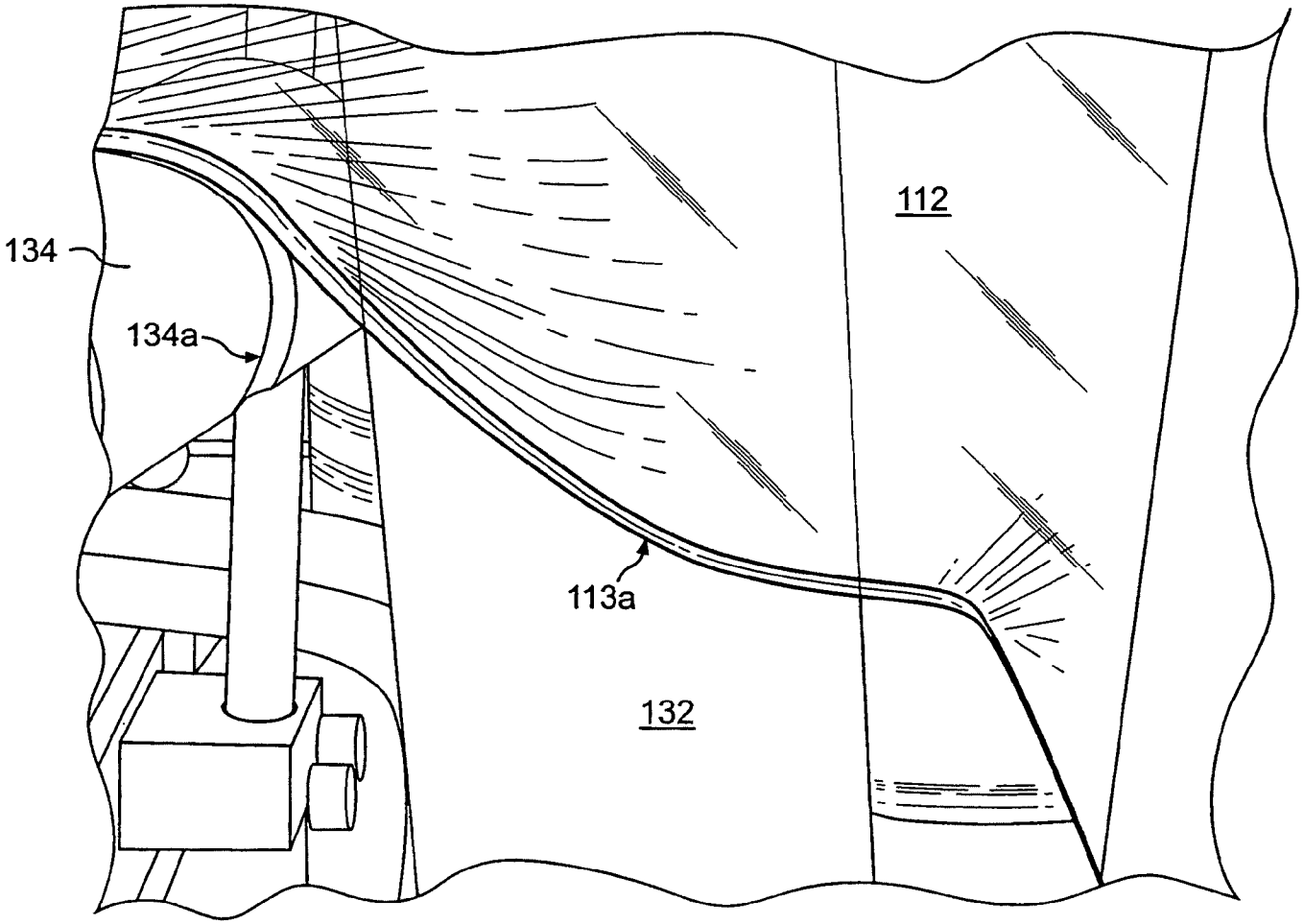
FIG. 2D is an isometric view of a cable rolling means and a rolled cable of film, according to one aspect of the invention.

As embodied herein and shown in FIG. 2A, an apparatus 100 includes a packaging material dispenser 102. As shown in FIG. 2A, packaging material dispenser 102 dispenses a sheet of packaging material 112 in a web form. The direction that the packaging material flows from the dispenser 102 is known as the film feed direction and is represented by arrow 103 in FIG. 2B. Packaging material dispenser 102 includes a roll of packaging material contained within a roll carriage 108. A film unwind stand 116 is mounted on a base of the roll carriage 108. The stand is constructed to support a roll of film 107 as the packaging material unwinds, moving from the roll of film 107 to a prestretch portion and a film guiding portion to be described below. The dispenser 102 is preferably mounted on a vertical structure, to be described later. The vertical structure may rotate around the load or may be fixed in place. The dispenser 102 is vertically movable on the vertical structure, to allow the dispenser to dispense packaging material along the height of the load. The film web 112, as dispensed from dispenser 102, has a top edge 112*a* and a bottom edge 112*b*. The width of the film web 112 is delineated by the top and bottom edges 112*a*, 112*b*. In a preferred embodiment, stretch wrap packaging material is used, however, various other packaging materials such as netting, strapping, banding, or tape can be used as well. As used herein, the terms "packaging material," "film," "film web," and "web" are interchangeable.

According to one aspect of the present invention, the apparatus 100 may include a prestretch portion configured to prestretch the film. The prestretch portion may be any type of conventional prestretch portion, including either powered roller stretch or unpowered roller stretch. The example described herein is intended as an example only, and in no way is intended to limit the type of prestretch portion used.

Figure 3:
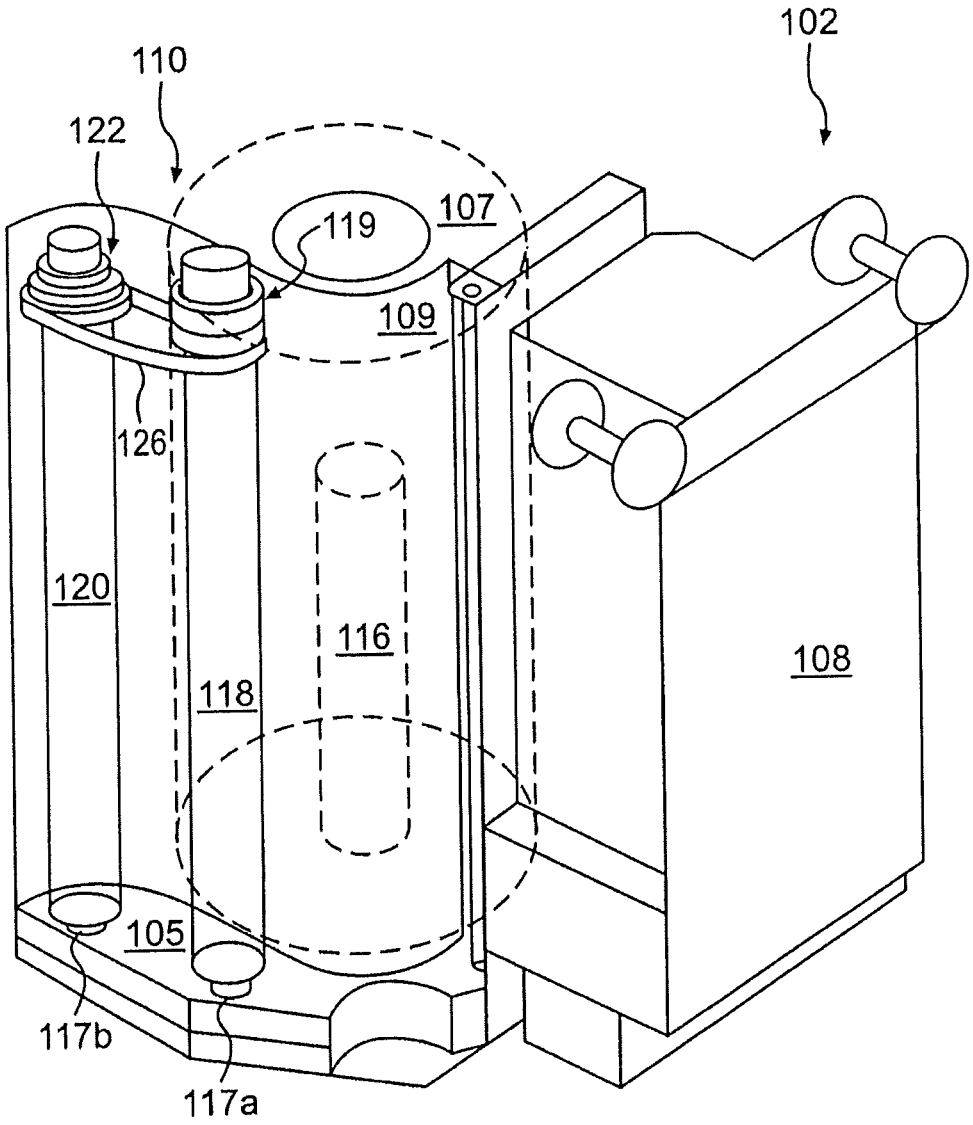
FIG. 3 is an isometric view of a dispenser and a prestretch portion of a wrapping apparatus, according to one aspect of the invention.

As embodied herein and shown in FIG. 3, a prestretch portion 110 may be provided in dispenser 102. The prestretch portion 110 may be unpowered, driven by movement of the packaging material 112. Prestretch portion 110 includes a first upstream prestretch roller 118 and a second downstream prestretch roller 120. "Upstream" and "downstream," as used in this application, are intended to define the direction of movement relative to the flow of packaging material from the dispenser 102. Thus, since the packaging material flows from the dispenser, movement toward the dispenser and against the flow of packaging material from the dispenser is defined as "upstream" and movement away from the dispenser and with the flow of packaging material from the dispenser is defined as "downstream." Neither of the rollers is connected to a power source, thus, both the first and second prestretch rollers are unpowered. Prestretch portion 110 is preferably hingedly connected to dispenser 102.

First and second prestretch rollers 118, 120 are preferably mounted in prestretch portion 110. Prestretch portion 110 preferably includes a base portion 105 for supporting first and second prestretch rollers 118, 120. Both prestretch rollers may be coated with a two-part urethane coating to enhance traction of the film over the rollers. However, it is preferred that the upstream roller (the first prestretch roller 118 located closest to film roll 107), be an uncoated steel roller to facilitate smooth unwind of film from the roll of film 107 while the downstream roller have a urethane coating. The urethane coating may help to prevent slippage of the film on the roller during prestretch.

According to one aspect of the present invention, the apparatus 100 includes an upstream guide roller 132 that is positioned downstream of the dispenser 102. If a prestretch portion 110 is provided, upstream guide roller 132 that is positioned downstream of the prestretch portion also. Preferably, upstream guide roller 132 is positioned in a substantially vertical position. Upstream guide roller 132 is positioned and configured to engage at least a portion of the width of the film web 112 as it leaves the dispenser or prestretch portion and may act to guide or drive a portion of the film web from a first level to a second lower level.

Upstream guide roller 132 is preferably coated with a cellular plastic to enhance traction of the film 112 on upstream guide roller 132. Preferably, the coating is applied to the roller to achieve a porous, cellular plastisol surface. The coating should have a low attraction to tackiness additives of the film web 112, a high coefficient of friction to prevent lengthwise slippage around the circumference of the upstream roller 132, and highly consistent tangential film release with corresponding minimal forces perpendicular to the film and radial to the roller. The coating helps to prevent slippage of the film web 112 on the guide roller 132. A preferred coating is disclosed in U.S. Pat. No. 5,186,981, issued on Feb. 16, 1993, and entitled "Rollers for Prestretch Film Overwrap," the entire disclosure of which is incorporated herein by reference. An example of a preferred coating is a plastisol commercially available from Dennis Chemical Company of St. Louis that is identified as PX-5565-B and contains 30-60% phthalate ester plasticizer, 30-60% wt. polyvinyl chloride resin, 1-5% wt. barium/cadmium PVC stabilizer mixture, less than 1% wt. black pigment, and less than 1% foam blowing agent and having a boiling range of 500-700 F, and a specific gravity of 1.18. Similar coatings that are not particularly sticky or tacky but that provide good traction for the film web as it moves over the guide roller 132 may also be used. Upstream guide roller 132 is rotatably mounted on a shaft (not shown) and preferably comprises a cylinder. Upstream roller 132 or the shaft may be journaled at its bottom for selective tilting and may include bearing means. The bearing means may be a rotational bearing or a linear bearing.

In applications where the dispenser 102 cannot move low enough to position the bottom portion of the film web 112 below the wrapping surface, upstream guide roller 132 may serve to guide the film web 112 to an elevation below the top 126*a* of the pallet 126 supporting load 124. In such an embodiment, means for tilting the upstream guide roller 132 may be provided. As embodied herein and shown in FIGS. 4A and 7C, the means for tilting may include a frame having a base portion 135 and a top portion 138.

Base portion 135 may be connected to the prestretch portion 110 of dispenser 102, preferably downstream of prestretch rollers 118, 120. Alternatively, base portion 135 may be connected to a different portion of dispenser 102.

A lower end of upstream guide roller 132 is preferably attached to base portion 135 via the shaft. An upper end of upstream roller 132 is preferably connected via the shaft to the top portion 138 of the frame. The base portion 135 and the top portion 138 provide a frame such that the upstream guide roller 132, positioned between the base portion 135 and the top portion 138, may be angled or tilted with respect to both the base portion 135 and the top portion 138. Upstream guide roller 132 may be permanently fixed between the base portion 135 and the top portion 138. Preferably, however, upstream guide roller 132 may be removably connected to the base portion 135 and the top portion 138. Both top portion 138 and base portion 135 may include a plurality of holes for receiving the shaft supporting upstream roller 132. The plurality of holes permit changing the position of the upstream roller 132. The position and degree of angle of the upstream guide roller 132 may be adjusted by changing the position of the upstream guide roller 132 with respect to the top portion 138 and/or base portion 135.

The upstream guide roller 132 may be angled or tilted in a direction generally perpendicular to a radius R from the center of rotation of the apparatus 100, as shown in FIG. 2A. Preferably, the upper end of the upstream guide roller 132 is at least partially tilted away from the film feed direction 103 (i.e., the direction from which the film is being dispensed from the roll of film 107). The upstream guide roller 132 may be tilted between about 10 and about 30 degrees away from the film feed direction 103.

Figure 4A:
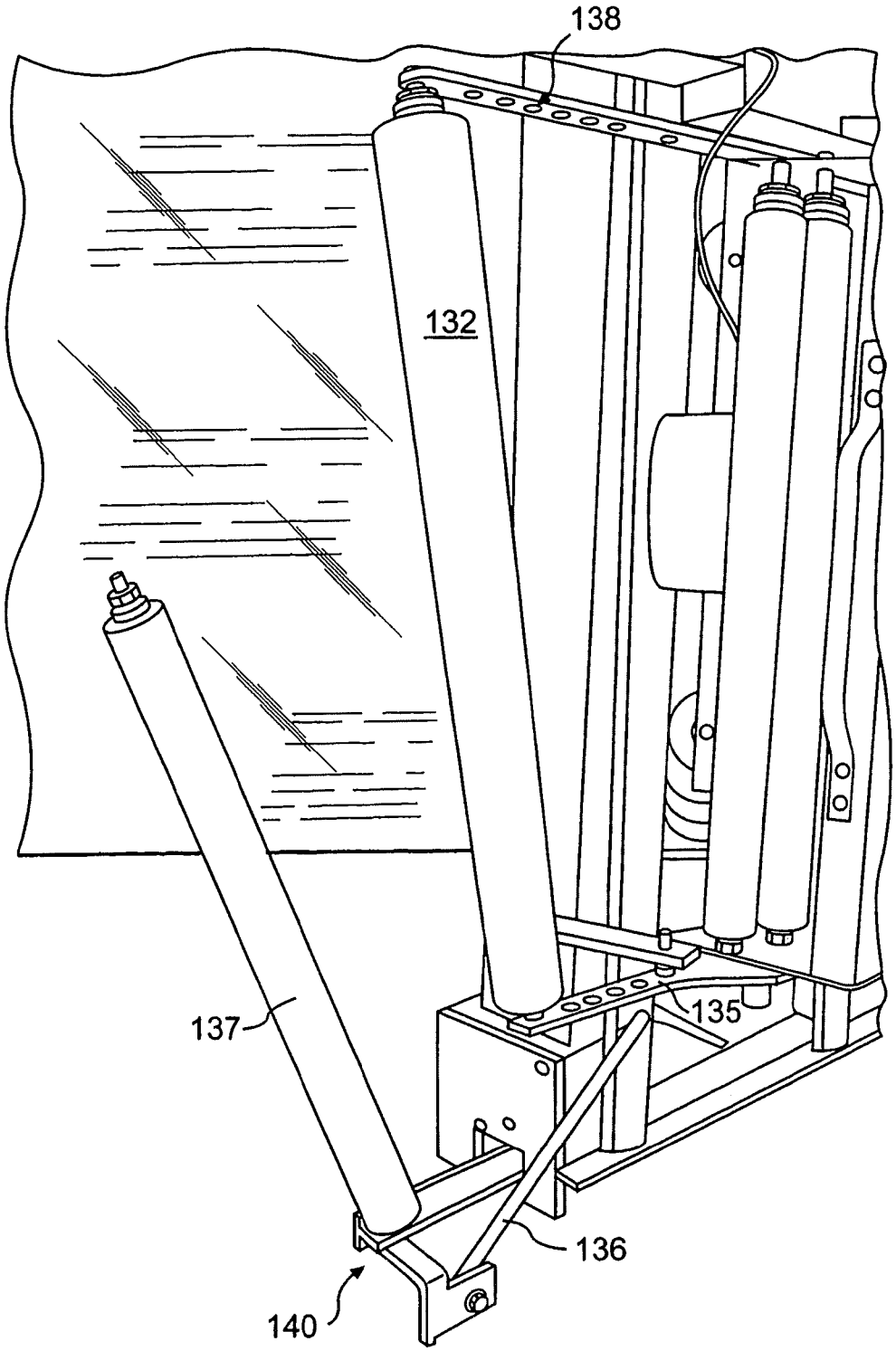
FIG. 4A is an isometric view of an embodiment of a wrapping apparatus having a first guide roller, a roping element, and a second guide roller in a disengaged position, according to one aspect of the invention.
Figure 4B:
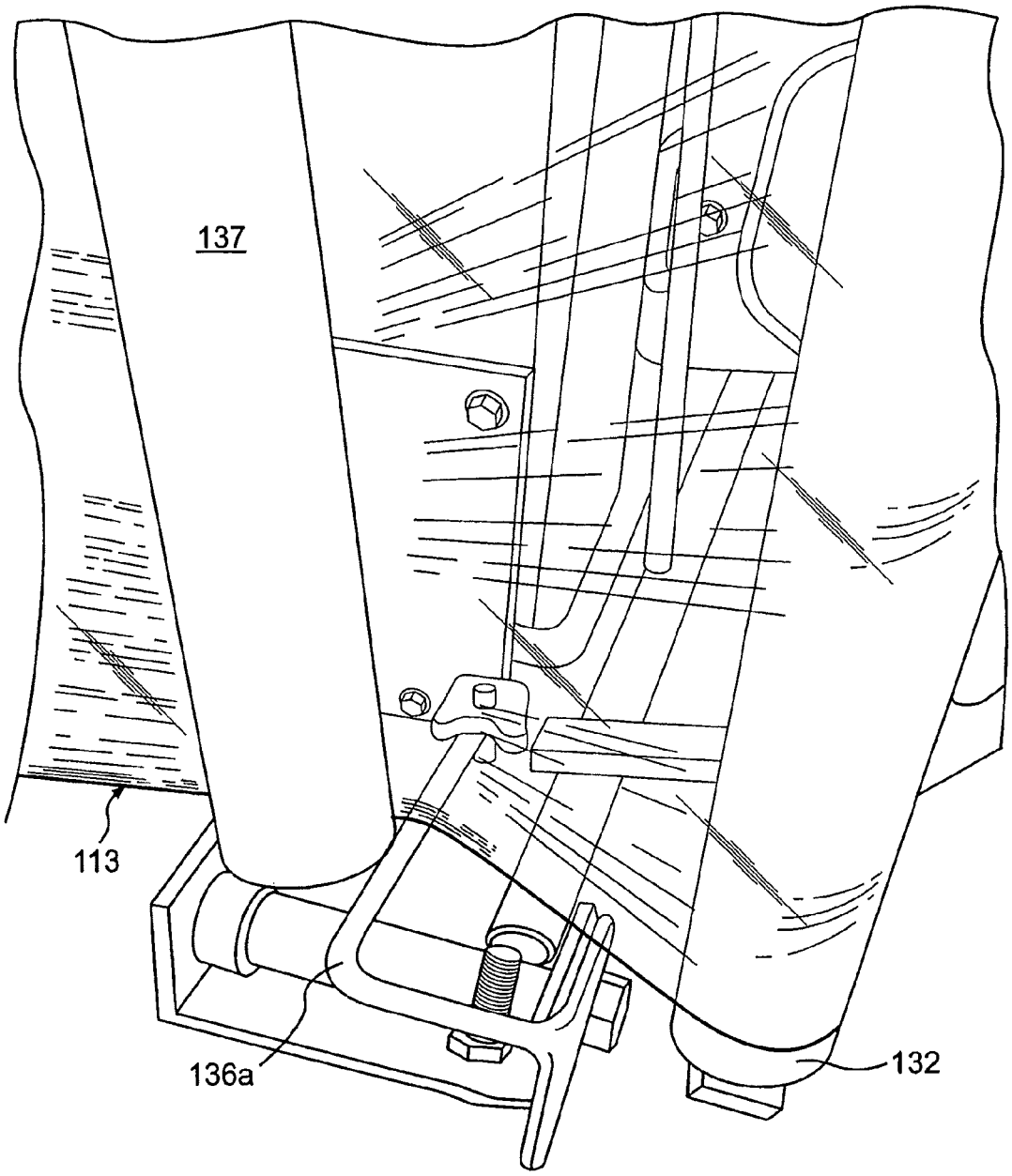
FIG. 4B is an isometric front end view of the apparatus of FIG. 4A, according to one aspect of the invention.
Figure 7A:
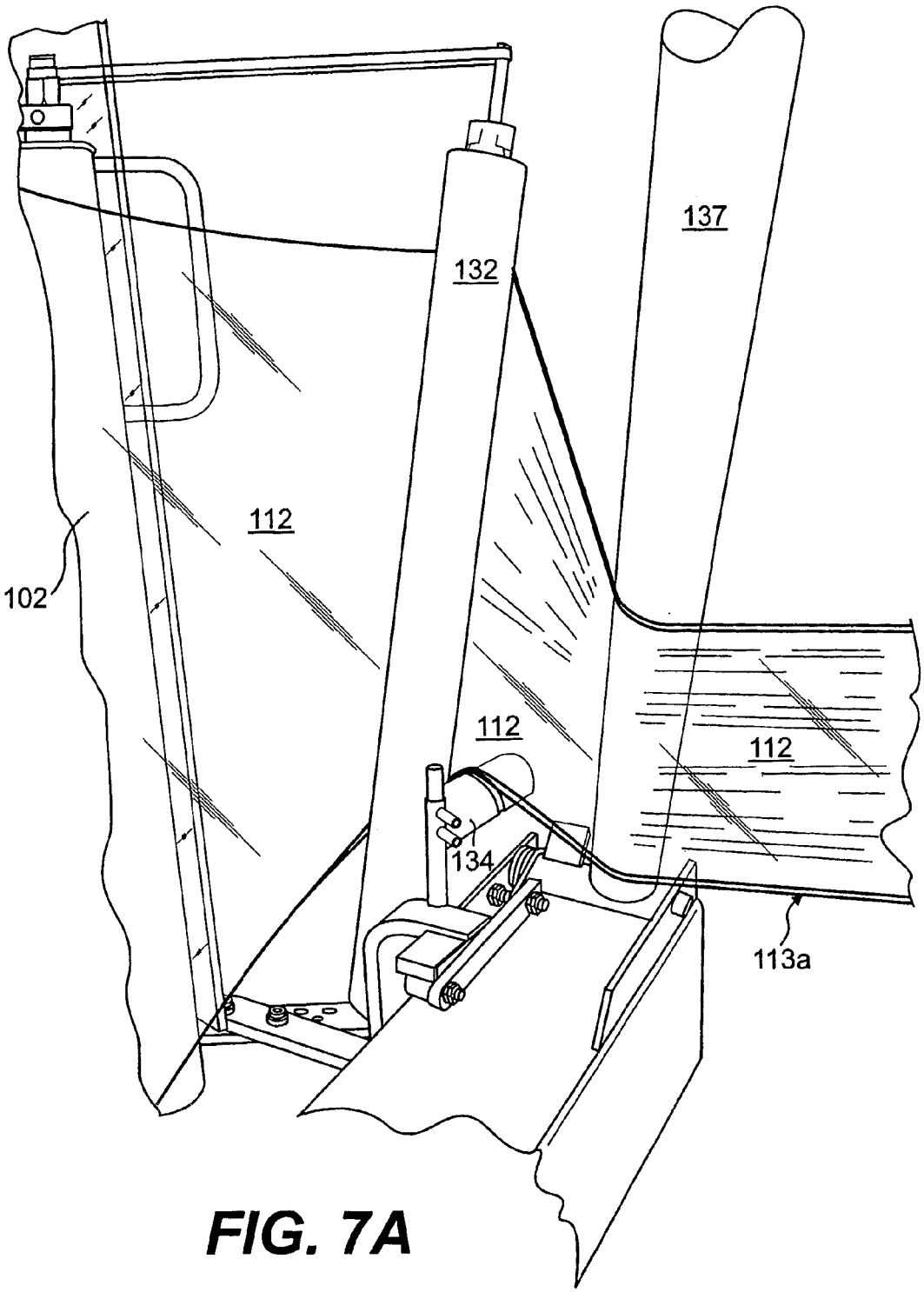
FIG. 7A is an isometric view of a wrapping apparatus in use to roll a portion of the film web into a rolled cable of film and to bias the portion of the film web not in the rolled cable, according to one aspect of the present invention.
Figure 7B:
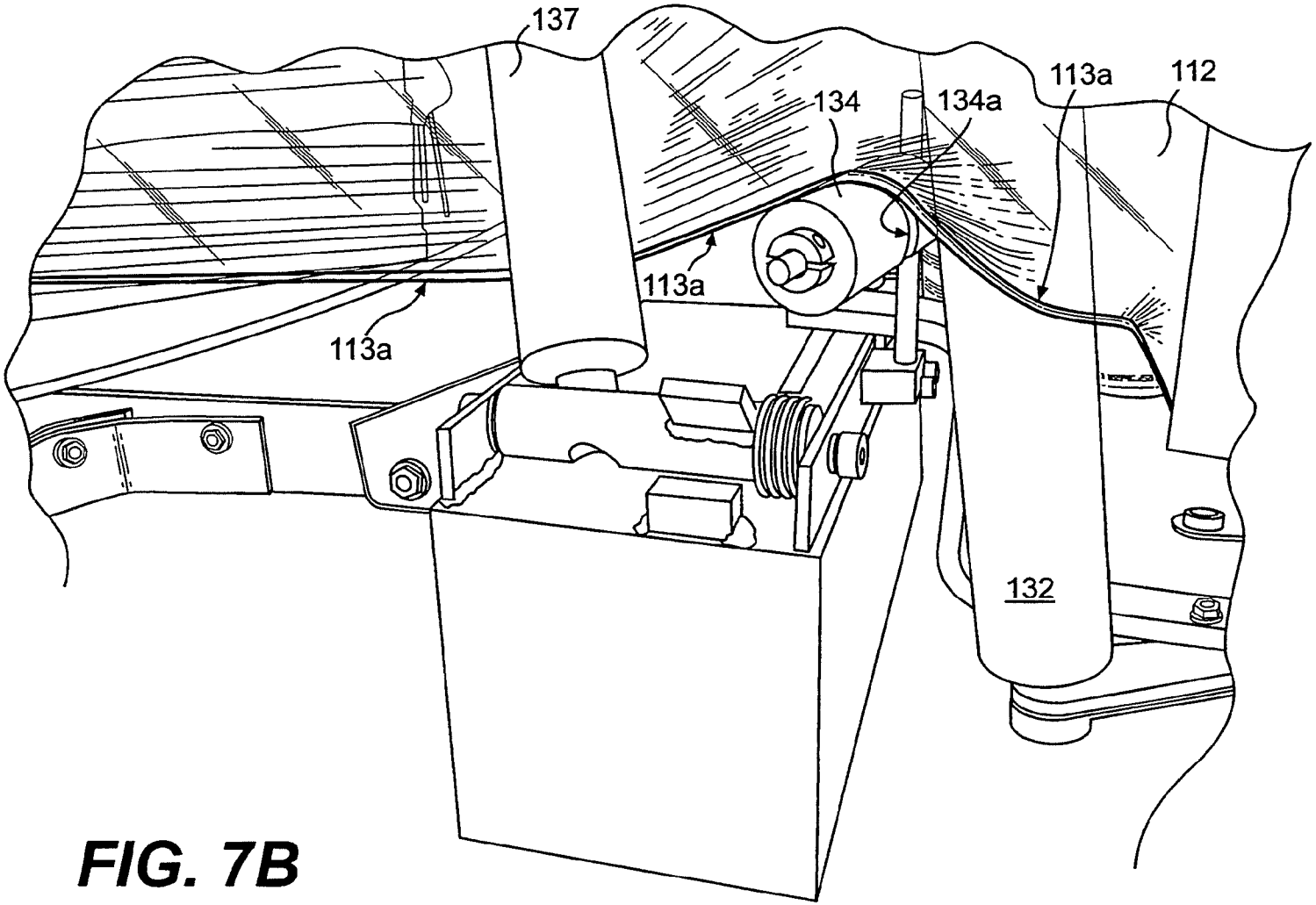
FIG. 7B is an enlarged isometric view of the guide rollers and cable roping roller of the apparatus of FIG. 7A, according to one aspect of the present invention.
Figure 7C:
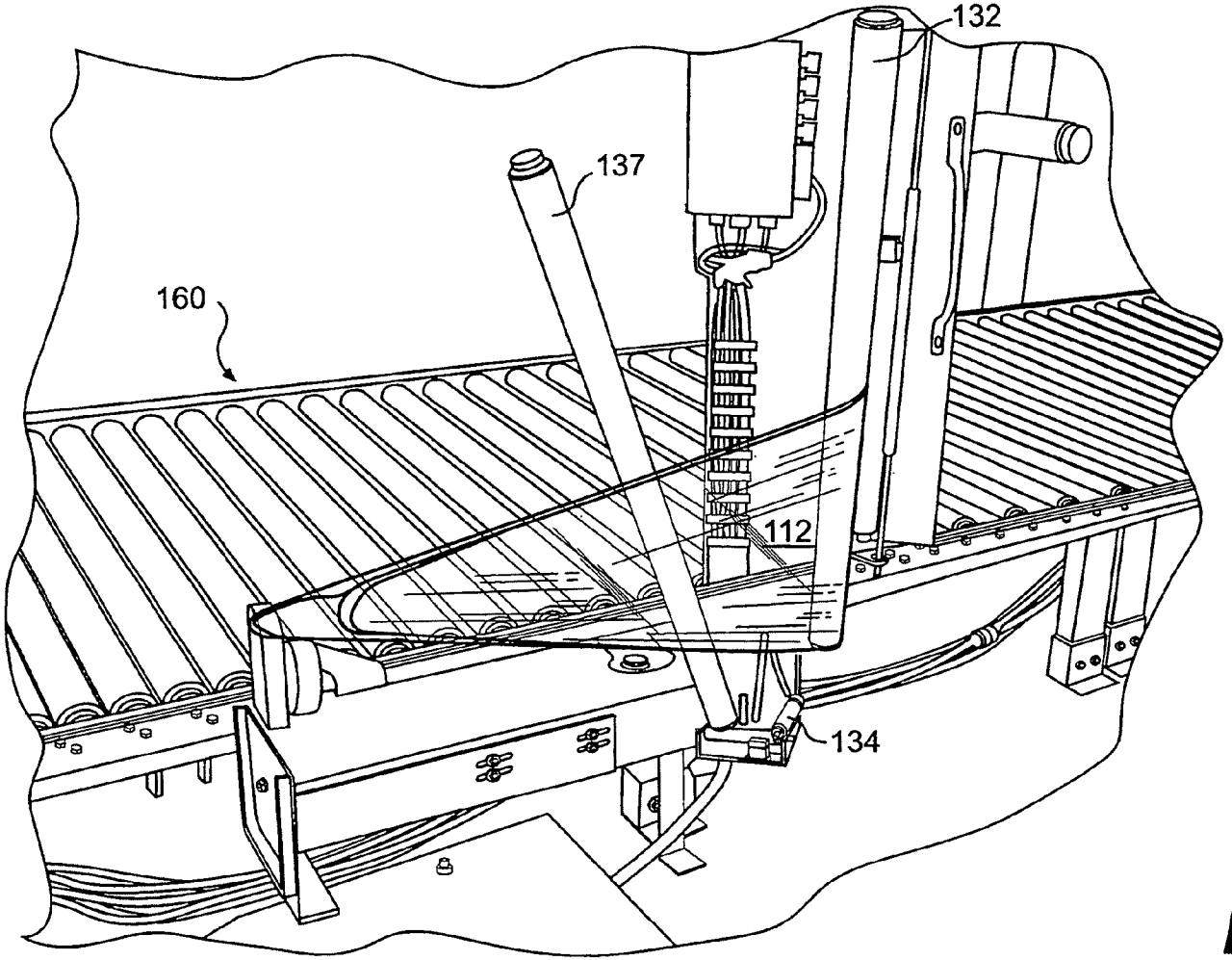
FIG. 7C is an isometric view of the wrapping apparatus of FIG. 7A in use with a rotating arm and conveyor.

As embodied herein and shown in FIGS. 2A, 2B, 4A, 4B, 5A, 5B, and 7A-7D, the apparatus 100 may include a downstream guide roller 137. Downstream guide roller 137 is positioned and configured to engage at least a portion of the width of the film web 112 as it leaves the dispenser or prestretch portion and guide or drive a portion of the film web from a first level to a second lower level. Downstream guide roller 137 is rotatably mounted on shaft (not shown) and preferably comprises a cylinder. Downstream guide roller 137 or the shaft may be journaled at its bottom for selective tilting and may including bearing means. The bearing means may be a rotational bearing or a linear bearing. A lower end of downstream roller 137 is preferably connected to a lever 140. An upper end of downstream roller 137 is preferably unconnected to any structure, as shown in FIGS. 4A and 7C.

Downstream guide roller 137 is selectively engageable with the film web 112, i.e., downstream guide roller 137 can be selectively positioned to engage the full width of the film web as it emerges from the dispenser 102 or the prestretch portion 110. Preferably, lever 140 is selectively engageable by at least a portion of dispenser 102. Lever 140 is preferably connected to a vertical structure that supports the dispenser 102, such as a rotatable arm or a mast. Lever 140 may be engaged by a portion of the dispenser 102 when the dispenser 102 is in its lowermost vertical position on the vertical structure upon which dispenser 102 moves. When dispenser 102 is at its lowermost point on the vertical structure, lever 140 is engaged by the dispenser 102, placing second guide roller 137 in an engaged position (see FIG. 7A). As the dispenser 102 moves upward on the vertical structure, film dispenser 102 disengages from the lever 140, and the downstream guide roller 137, attached to lever 140, remains at the bottom of the vertical structure, placing second downstream guide roller 137 in an unengaged position (see FIG. 4A). As shown in FIGS. 4A, 7A, and 7C, downstream guide roller 137 is positioned away from the film path when it is in the disengaged position, and downstream guide roller 137 is positioned to intercept the film path when it is the engaged position.

Alternatively, the lever 140 and downstream guide roller 137 may be attached to the roll carriage 108 of dispenser 102 and move with the dispenser as it travels along the vertical structure. In such an embodiment, other suitable means, such as a mechanical linkage, could be provided to move the downstream guide roller 137 into the engaged position only when the dispenser 102 is at the bottom of the vertical structure. Alternatively, the second roller may be actuated by a cable linkage to the film carriage 108.

According to one aspect of the invention, the weight of the dispenser 102 actuates the lever 140, pushing down on one end of lever 140 and causing the other end of lever 140, and attached downstream guide roller 137, to rise up into the engaged position. Removal of the weight of dispenser 102 releases lever 140, allowing downstream guide roller 137 to lower to the disengaged position. Preferably, the downstream guide roller 137 is in the engaged position only when the base of the load and the top of the pallet are being wrapped. Thus, as the dispenser 102 moves vertically upward on the vertical structure to wrap the load, the lever 140 is released, disengaging downstream guide roller 137, and when the dispenser returns to the bottom of the vertical structure at the end of the wrap cycle as the base of the load and pallet are being wrapped, the lever 140 is engaged, moving the downstream guide roller 137 into engagement with the film web being dispensed.

The downstream guide roller 137 may be angled or tilted in a direction generally perpendicular to a radius R from the center of rotation of the apparatus 100, as shown in FIG. 2A. Preferably, the upper end of the downstream guide roller 137 is at least partially tilted away from the film feed direction 103 (i.e., the direction from which the film is being dispensed from the roll of film 107) and at least partially away from the first upstream guide roller 132. Preferably, if the upstream guide roller 132 is tilted, the upstream and downstream guide rollers 132, 137 are tilted in generally opposite directions. The downstream guide roller 137 is preferably tilted between about 15 and about 45 degrees away from the film feed direction 103. Thus, the upstream and downstream guide rollers 132, 137 may be positioned, when the downstream guide roller 137 is engaged, to form an "S" pattern, as shown in FIG. 2A. This configuration of the upstream and downstream guide rollers 132, 137 allows engagement between the downstream guide roller 137 and the film web 112, as the web 112 passes to the load 124, of between about 45 degrees and about 125 degrees. Alternate configurations of the rollers are possible with the use of additional guide rollers.

Downstream guide roller 137 may act as means to drive film web 112 to an elevation below the top 126*a* of pallet 126. Downstream guide roller 137 may alternatively combine with upstream guide roller 132 to form means for driving the film to that elevation, such that the driving down of the film is a two-step process. Alternatively, upstream guide roller 132 may not act to drive the film down, i.e., may not be tilted, and only downstream guide roller 137 will drive the film downward to an elevation below the top 126*a* of pallet 126.

The tilted configuration of the upstream and downstream guide rollers 132, 137, that forms the "S" pattern causes the bottom of the web of film 112 leaving the downstream guide roller 137 to be lower than the bottom of the web of film 112 leaving the film unwind stand 116. It should be understood that each roller 132, 137 is capable of being tilted, and it is therefore possible to use various positioning combinations of the rollers. For example, both rollers may be tilted, neither roller may be tilted, only roller 132 may be tilted, or only roller 137 may be tilted.

Figure 5A:
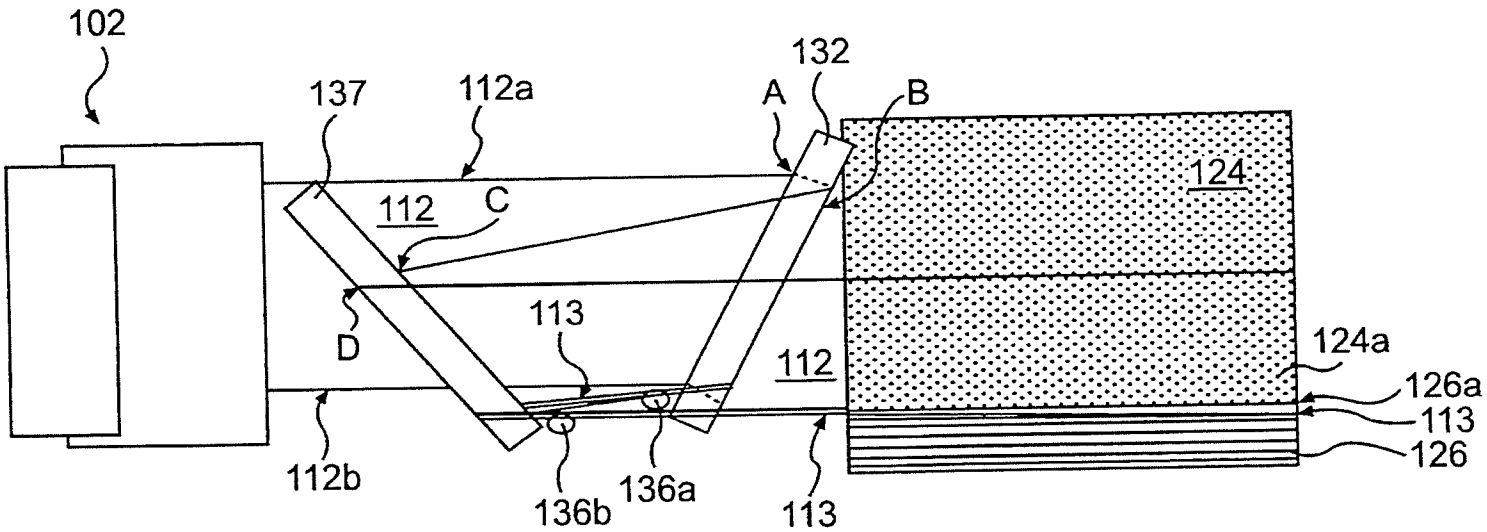
FIG. 5A is a simplified schematic showing first and second guide rollers and first and second roping elements of a wrapping apparatus in use, according to one aspect of the invention.
Figure 5B:
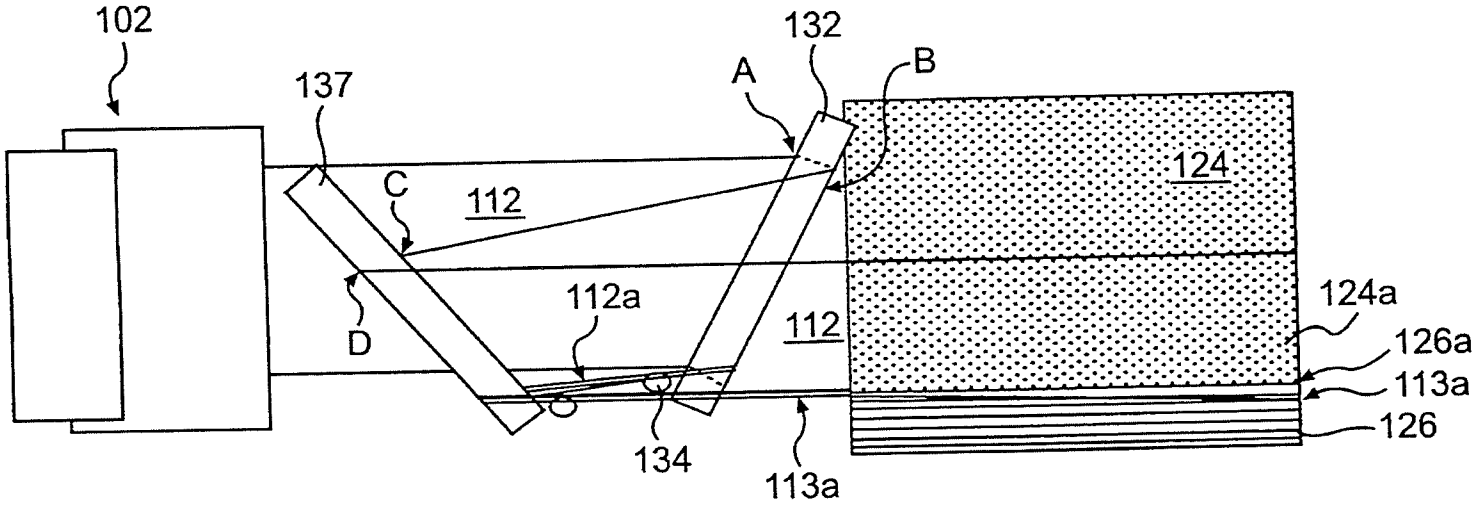
FIG. 5B is a simplified schematic showing first and second guide rollers and a cable rolling roper of a wrapping apparatus in use, according to one aspect of the invention.

As embodied herein and shown in FIGS. 5A and 5B, the top of the film web leaves the film roll 107, passes through the prestretch portion 110 (not shown) if provided, and engages upstream guide roller 132 at a first elevation A. As the film web 112 engages the upstream guide roller 132, the upstream guide roller 132 rotates and the film maintains contact with the upstream guide roller 132 as the film web 112 works down the roller 132 in a screw-like fashion, due at least in part to the tilt of the roller 132. The film web 112 is drawn off upstream guide roller 132 at an elevation B that is lower than elevation A. As the film web 112 leaves upstream guide roller 132, the portion of the film web that slid down the upstream guide roller 132 moves over a roping element (to be discussed below) to form a rope portion at the bottom of the film web 112. As will be discussed below, the rope of film may be a gathered, i.e., compressed, rope of film 113 or a rolled cable of film 113*a*. The film web 112 with the roped portion then engages the tilted downstream guide roller 137 at an elevation C that is equal to or lower than elevation B, depending upon the direction of the tilt of the downstream guide roller 137. As the downstream guide roller 137 rotates, the film web 112 maintains contact with the roller surface. The film web 112 works down the downstream guide roller 137 in a screw-like fashion, due in part to the tilt of the downstream guide roller 137, and the film web 112 with roped bottom portion is drawn off downstream guide roller 137 at an elevation D that is lower than elevation C.

Preferably, the film web 112 is moved down the tilted roller 137 a sufficient distance such that at least a top portion 126*a* of a pallet 126 and the bottom 124*a* of the load 124 are wrapped with the packaging material 112. As previously discussed in the Background of the Invention, pallets are typically between 5 and 8 inches in height. It is preferable that the bottom 3 inches of the pallet 126 remain unwrapped so that the tines of a fork truck can be placed under/into the pallet to lift and remove the wrapped load without destroying the film web.

The change in elevation of the film web 112 is dependent upon the degree of tilt of the roller(s). The larger the tilt of the roller(s), the greater the change in elevation of the film web 112 from the time the film web 112 engages a roller to the time the film web 112 leaves the roller. As the roller tilt increases, the film web 112 moves down the roller in a screw-like fashion, creating a difference in elevation greater than can be accounted for by the movement of the film around the roller. The excess film that slides to the bottom of the tilted roller is gathered into a rope of film.

Although it is preferred that the upstream and downstream guide rollers are tilted in generally opposite directions, such a configuration may not be possible due to conflicts with other machine components. In a most preferred embodiment, the upstream and downstream guide rollers will be positioned such that the film web 112 will remain in contact with the rollers for at least 90 degrees and for less than 180 degrees. That is, the surface of the roller comprises a circle, or 360 degrees. The amount of the roller surface that the film web engages corresponds to the contact. For example, if the film web 112 wraps around the roller to change direction 180 degrees, then the film web 112 contacts ½ of the roller surface or 180 degrees. If the film web 112 uses the roller to change direction 90 degrees, then the film web 112 contacts ¼ of the roller surface or 90 degrees. This allows the angle of the roller to lower the film web 112 from a first elevation at which the film comes into contact with the roller to a second, lower elevation at which the film web 112 leaves the roller.

In addition, although it is preferable that two guide rollers are used to drive the film to a lower elevation, it is possible for less than two or more than two rollers to be used. Also, the path formed by the rollers need not be an "S" configuration if additional idle rollers are used to direct the film.

According to one aspect of the present invention, apparatus 100 includes a roping element for creating a rope of film along an edge portion of the web of film 112. In one embodiment, two film roping elements may be provided. As embodied herein and shown in FIG. 5A, two film roping elements 136*a*, 136*b* may be provided. Film roping elements 136*a*, 136*b* may include a bar, a tilted roller, or a wheel. Preferably, each roping element 136*a*, 136*b* is positioned on a downstream side of one of the guide rollers 132, 137, such that a roping element is adjacent a downstream side of each guide roller 132, 137. Alternatively, although not preferred, the roping elements 136*a*, 136*b* may be positioned near a respective upstream side of each guide roller 132, 137. Each roping element 136*a*, 136*b* is preferably positioned as close as possible to the downstream side of the respective guide roller 132, 137. Second roping element 136*b* is preferably movable with downstream guide roller 137 between the engaged and disengaged positions. Additionally, first roping element 136*a* may also be connected to lever 140 such that it also is movable with downstream guide roller 137 between the engaged and disengaged positions (see FIG. 4*a*). The roping element should be positioned such that it pushes the bottom edge of the film web 112 upward into the web 112, compacting the web of film as it comes off the guide roller 132, 137, and creating a rope of film 113 at the bottom of the web of film 112. The roping elements 136*a*, 136*b* may be tilted in order to push the film upward to create a tight rope 113 of film 112. The inventors have found that the closer the roping elements 136*a*, 136*b* are placed to the downstream side of the respective guide roller 132, 137, the tighter the resultant rope 113.

Preferably, the roping elements 136*a*, 136*b* include low friction materials, for example unpainted steel bars or elements coated with zinc chromate. Although this embodiment uses two roping elements, it is possible that only one roping element 136*a* may be used. If only one is used, it may be placed adjacent the downstream side of upstream guide roller 132 or downstream guide roller 137. Although not preferred, it could also be positioned on the upstream side of one of the guide rollers 132, 137.

In an alternative embodiment, the roping element includes a cable rolling roper 134, as shown in FIGS. 2D, 5B, and 7A-7D. The cable rolling roper 134 works with upstream guide roller 132 to create a rolled rope of film 113*a* that is capable of maintaining its structural integrity as a rope structure during and after wrapping of a load. The cable rolling roper 134 and guide roller 132 may form a "cable rolling means" for rolling a portion of the film web into a cable of film 113*a*. The cable rolling means rolls an outer edge of the film web inward upon itself and toward the center of the film web. The film is rolled upon itself to form a tightly rolled cable of film 113*a*, or a high tensile cable of film along an edge of the film web 112. As used herein, a "cable of film" or a "rolled cable" or a "rolled rope" are intended to denote a specific type of "roped" packaging material, where the film web has been rolled upon itself to create the rolled cable structure.

Figure 7D:
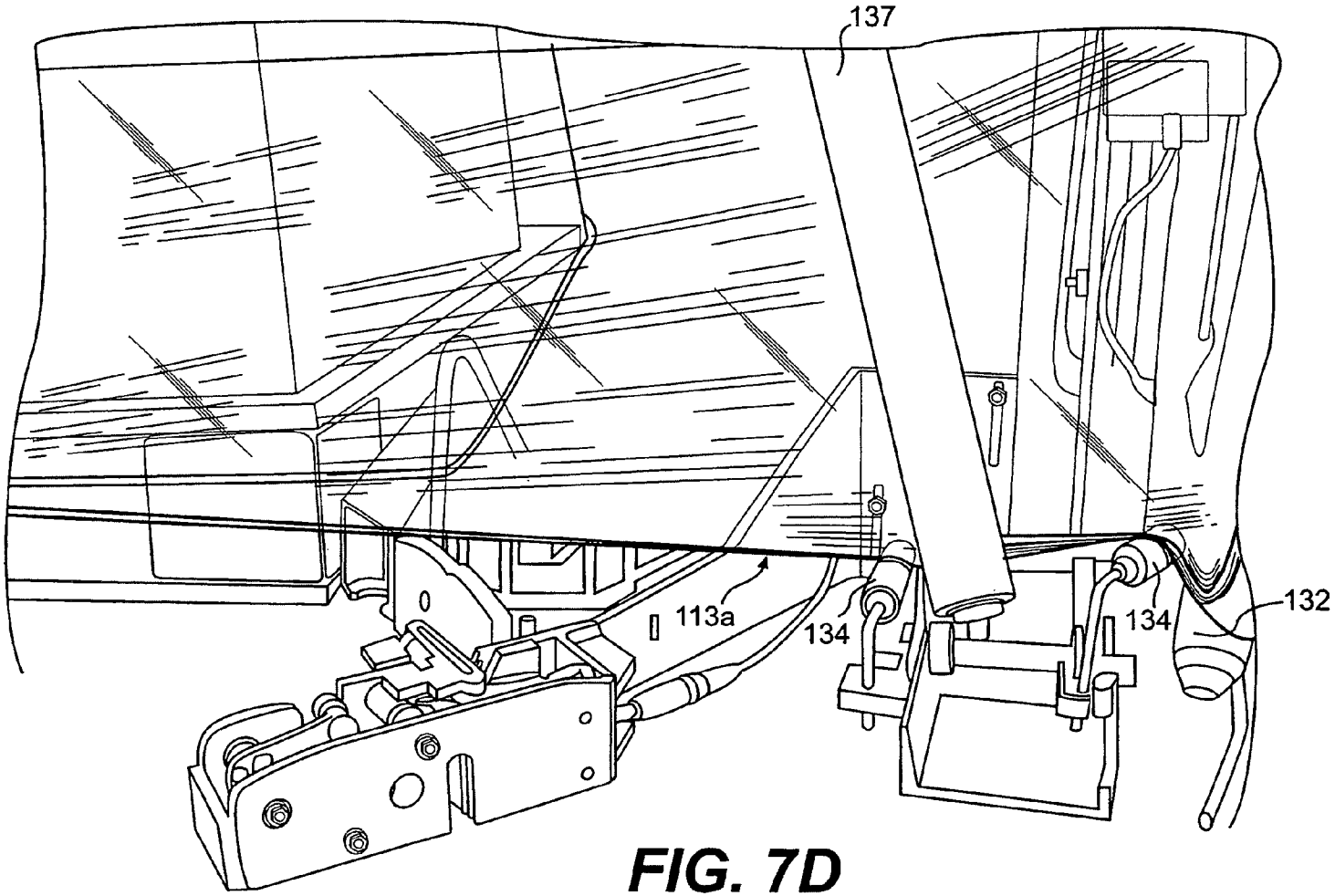
FIG. 7D is an isometric view of a wrapping apparatus, having two cable rolling ropers, in use with a rotating wrapping arm, according to one aspect of the present invention.

As embodied herein and shown in FIGS. 5B and 7A-7C, cable rolling roper 134 may be positioned near the upstream roller 132, and preferably is positioned adjacent the upstream roller 132. Alternatively, as shown in FIG. 7D, two cable rolling ropers 134 may be used, one positioned near each guide roller. Although it is preferable that the cable rolling ropers 134 are placed downstream of the guide rollers as shown in FIG. 7D, it is possible to place the ropers 134 upstream of the guide rollers.

In a most preferred embodiment, cable rolling roper 134 is a roller positioned downstream of guide roller 132 and immediately adjacent to guide roller 132, as shown in FIG. 7A. Neither roller 132 nor roper 134 is connected to a power source, both rollers are unpowered. Cable rolling roper 134 preferably does not include a coating. A preferred material from which the roller forming roper 134 may be made is nylon. Other suitable materials may be used. Cable rolling roper 134 has a circumferential groove 134*a* around the circumference of the roller. Groove 134*a* is configured to receive and roll an edge 112 *a*, 112*b* of the film web 112. In a preferred embodiment, groove 134*a* is "V" shaped. However, other shapes may be used for groove 134*a*.

Cable rolling roper 134 is preferably positioned immediately adjacent to and downstream of roller 132. Cable rolling roper 134 may be positioned adjacent to a bottom portion of roller 132 with groove 134*a* positioned to receive a bottom edge 112*b* of film web 112 in order to roll a bottom portion of the film web 112 into a cable 113*a*. This positioning is preferred such that, in use, the packaging material 112 is pulled off roll 107, passes over first upstream prestretch roller 118 to downstream prestretch roller 120, passes from prestretch roller 120 to upstream guide roller 132, and over cable rolling roper 134 to load 124. Cable rolling roper 134 preferably is positioned on base portion 135 immediately adjacent a downstream side of guide roller 132. Alternatively, as will be discussed below, the cable rolling roper 134 may be connected to a lever 140. Alternatively, cable rolling roper 134 may be positioned adjacent to a top portion of roller 132 with groove 134*a* positioned to receive a top edge 112*a* of film web 112 in order to roll a top portion of film web 112 into a cable 113*a*. In an alternative embodiment, two cable rolling rollers 134 may be provided, one positioned adjacent a top portion of roller 132 and the other roper 134 positioned adjacent a bottom portion of roller 132 in order to roll both a top and a bottom portion of the film web 112 into cables 113*a*.

Figure 6A:
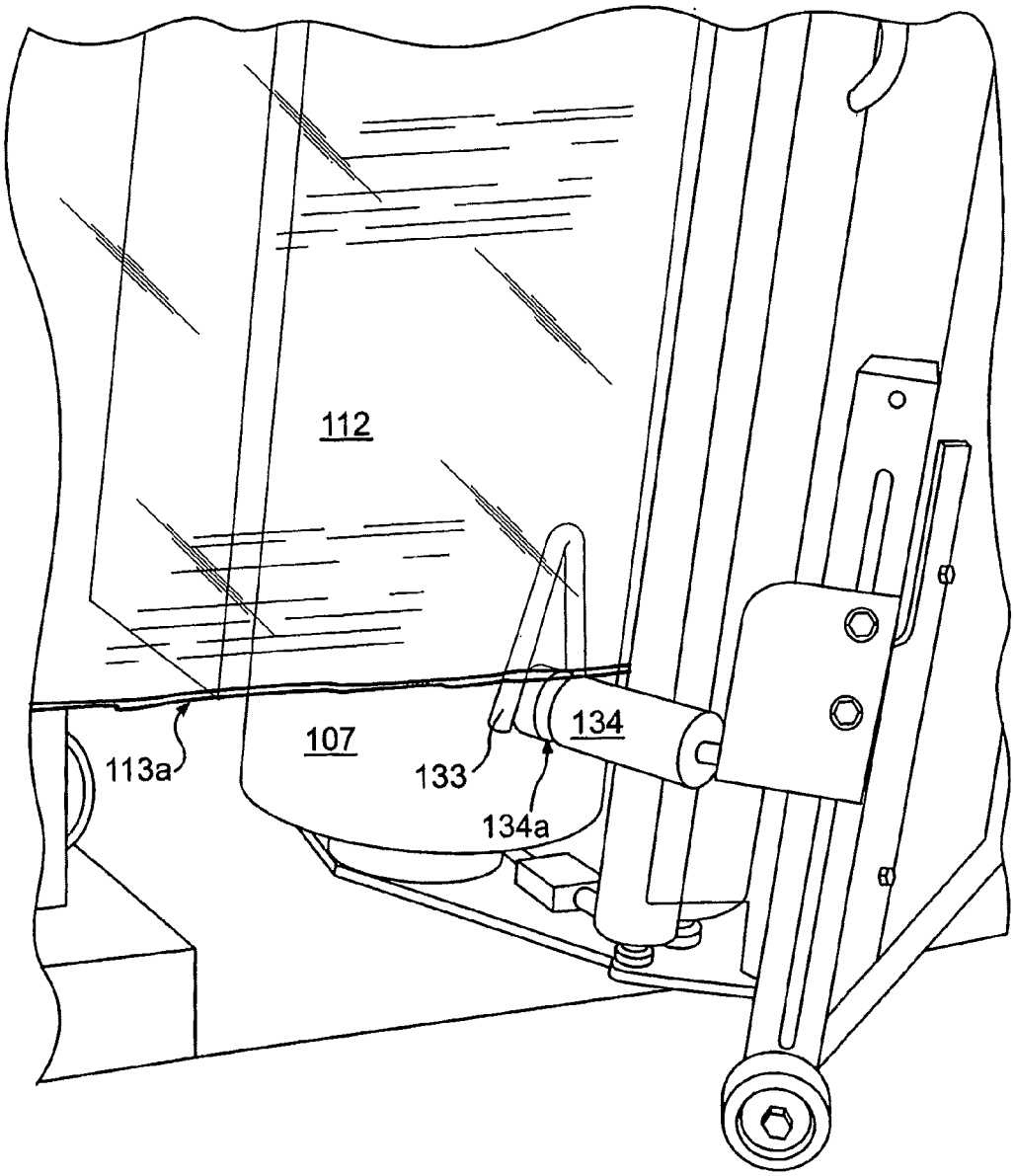
FIG. 6A is an isometric view of a cable rolling roper engaged with the film web and without the use of guide rollers, according to one aspect of the present invention.
Figure 6B:
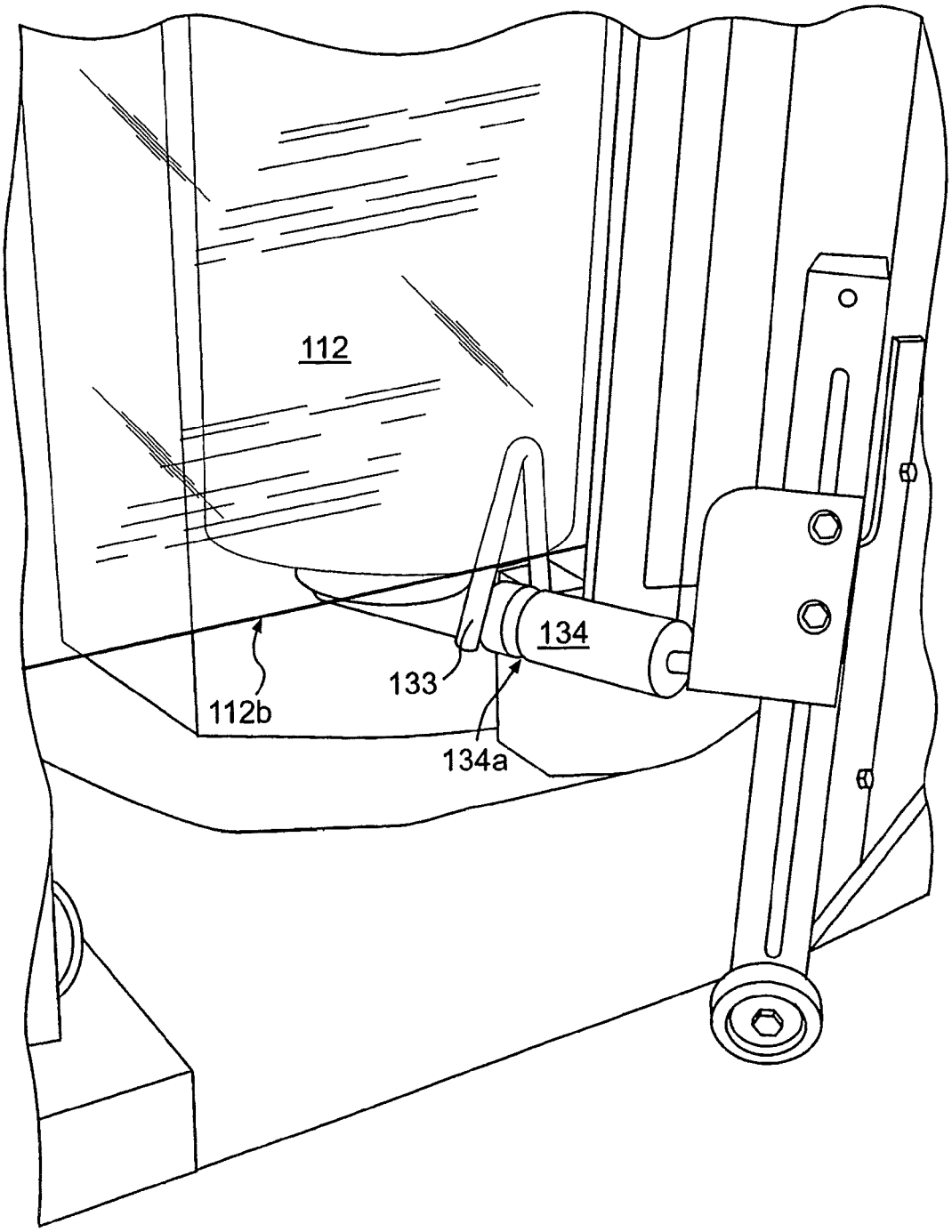
FIG. 6B is an isometric view of the cable rolling roper of FIG. 6A disengaged from the film web, according to one aspect of the present invention.
Figure 6C:
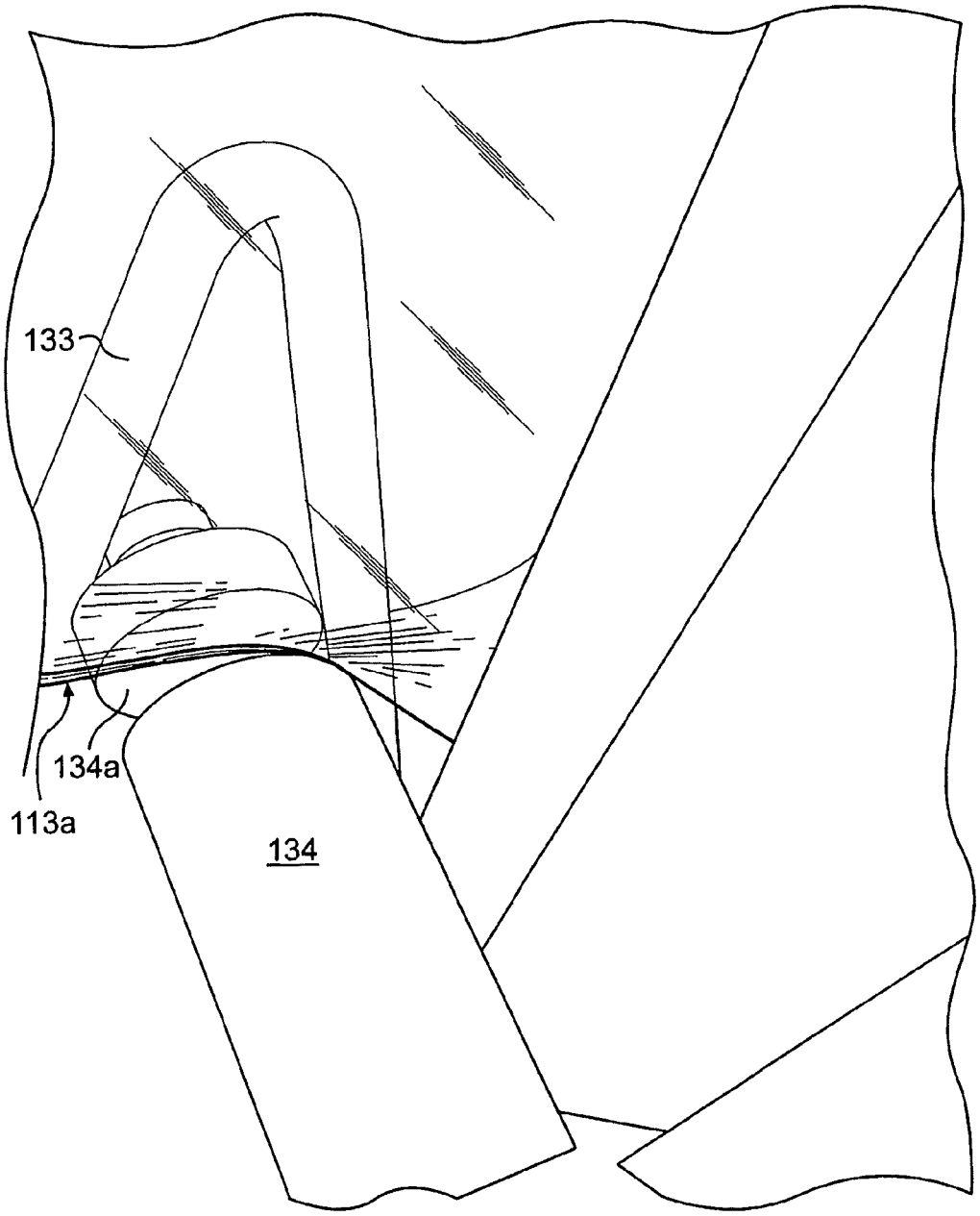
FIG. 6C is an enlarged isometric view of the cable rolling roper of FIG. 6A showing the groove of the cable rolling roper, according to one aspect of the present invention.

According to another aspect of the invention, as embodied herein and shown in FIGS. 6A-6C, when a cable rolling roper 134 is provided, guide rollers 132, 137 may be replaced by a bar 133. In such an embodiment, cable rolling roper is positioned at a base of a mast upon which dispenser 102 moves vertically. When the dispenser 102 is at the base of the mast, groove 134*a* of cable rolling roper 134 engages an edge 112*b* of film web 112 as it moves toward the load 124 (FIG. 6A). In this embodiment, it is preferred that the load 124 is supported on a rotatable turntable (not shown), to provide relative rotation between the load 124 and the dispenser 102 to wrap the film web around the load. As the dispenser moves upward on the mast, the edge 112*b* of the film web 112 disengages from cable rolling roper 134 (FIG. 6B). When the dispenser returns to the base of the mast as the end of the wrap cycle approaches, edge 112*b* of the film web 112 is re-engaged by groove 134*a* of cable rolling roper 134 and is rolled into a rolled cable of film 113*a*, which is wrapped around the base of the load and top of the pallet supporting the load.

Figure 11:
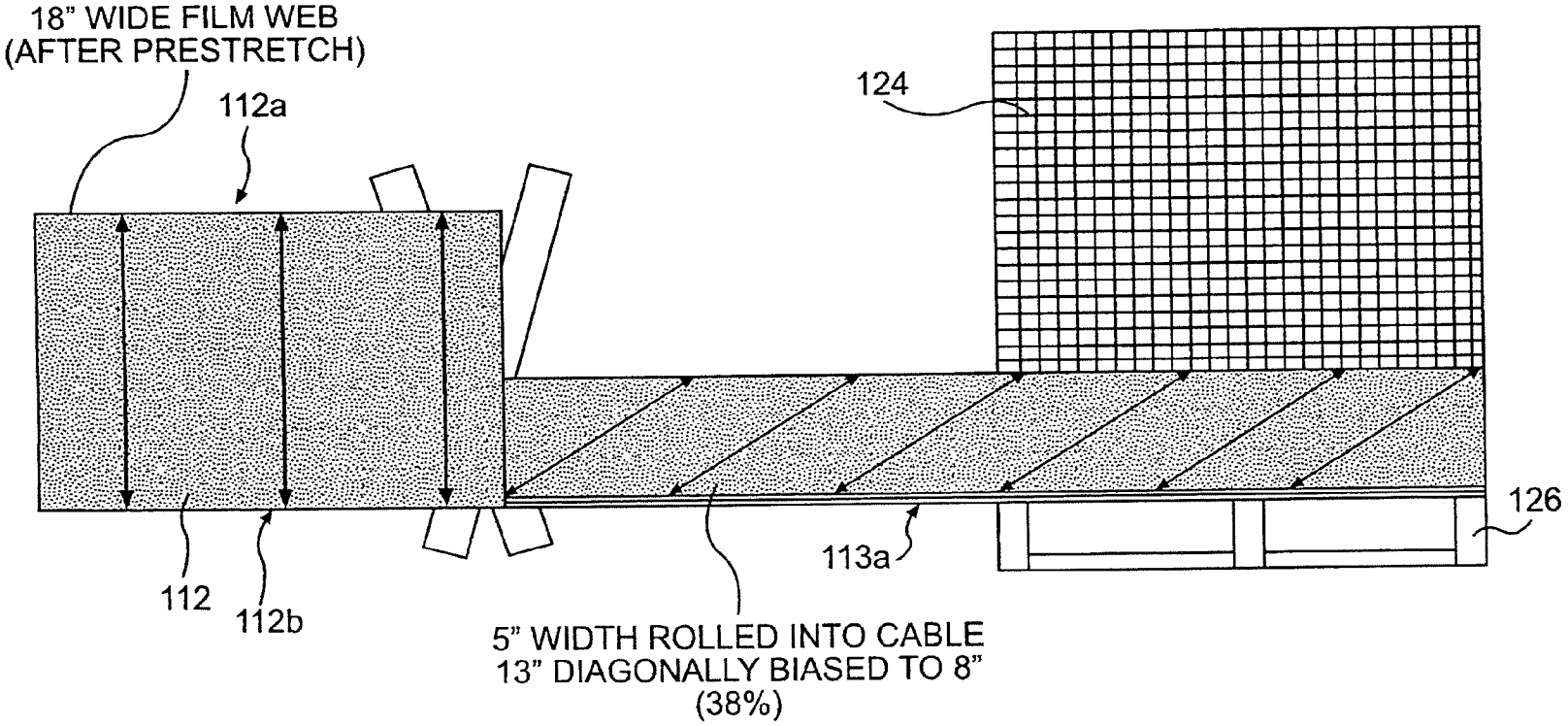
FIG. 11 is a simplified schematic of a biasing means of a wrapping apparatus in use, according to one aspect of the invention.

According to another aspect of the invention, the downstream guide roller 137 may act as a selectively engageable means for biasing the film web 112. As discussed above, downstream guide roller 137 is selectively engageable with the film web 112. When engaged with the film web 112, guide roller 137 biases the film web 112 as it comes off of upstream guide roller 132. This is shown in FIGS. 7A and 11. As used herein, the phrase "biasing the film web" is intended to describe the method of applying a force to the film, such that if the film, for example, has a vertical line drawn upon it prior to the application of the biasing force and then is acted upon by this force, the line on the biased film would be diagonal across the film web. Generally, the film is "pulled," by the downstream roller 137, away from upstream roller 132, the two rollers being angled away from each other, as shown in FIG. 7A, such that the downstream roller pulls down on the film at an angle, imparting the bias to the film. More simply, biasing the film includes stretching the film on a diagonal between angled rollers. Biased film can be applied to the load at moderate wrap forces and film breaks will not be incurred. The amount of bias imparted to the film can be adjusted by adjusting the tilt of the downstream guide roller 137.

Figure 8:
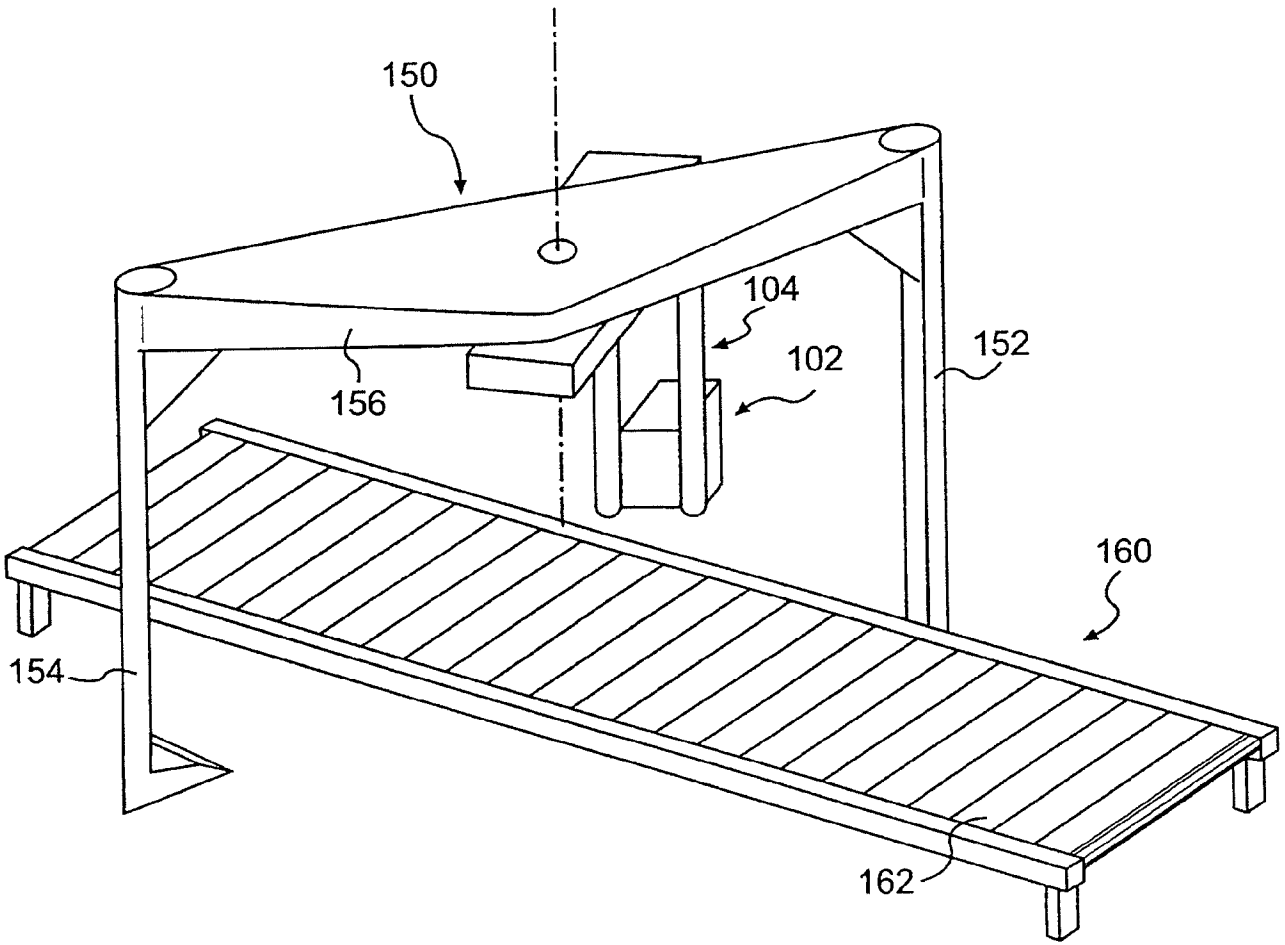
FIG. 8 is an isometric view of an embodiment of a wrapping apparatus according to one aspect of the invention.
Figure 9:
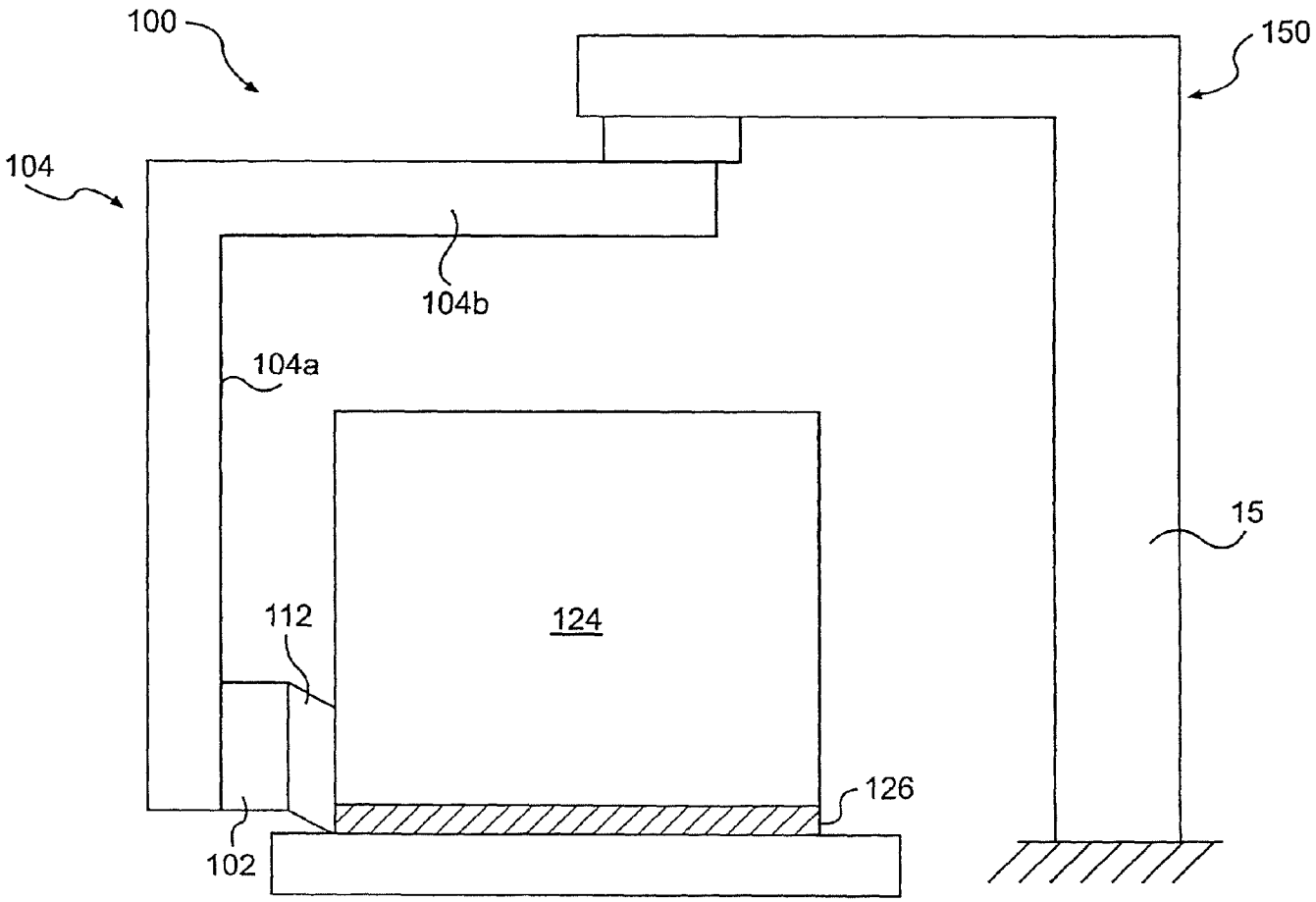
FIG. 9 is a side view of an alternative embodiment of a wrapping apparatus according to an aspect of the invention.

According to another aspect of the present invention, apparatus 100 includes means for providing relative rotation between the load and the dispenser. As shown in FIGS. 8 and 9, a frame 150 may be provided. As shown in FIG. 8, the frame preferably includes a first leg 152 and a second leg 154. Both legs extend upward substantially vertically from a mounting surface, which can be a floor or some other structure built upon a floor. As shown in FIG. 8, brackets are provided for securing the legs to the mounting surface. The frame 150 may include a bridge 156 that connects the legs. Although it is preferred that frame 150 includes two legs as shown in FIG. 8, it is possible that only one leg 152 may be provided, as shown in FIG. 9, or that more than two legs are provided.

Frame 150 rotatably supports packaging material dispenser 102. As shown in FIGS. 8 and 9, dispenser 102 is mounted on a vertical structure such as a rotary arm 104. Rotary arm 104 has a first portion 104*a* secured to a bearing member and a second portion 104*b* holding the dispenser 102. The first portion 104*a* of the arm 104 is rotatable about a vertically extending axis of rotation of the apparatus 100 to wrap packaging material around the sides of the load 124.

A motor drive (not shown) is provided for providing relative rotation around the generally vertical axis between the packaging material dispenser 102 and the load 124 to wrap packaging material 112 about the sides of load 124. The drive rotates rotatable arm 104*a* and dispenser 102 about generally vertical axis to wrap packaging material around the sides of load 124.

Alternatively, roll carriage 108 of dispenser 102 may be mounted on a wrapping ring (not shown) to dispense packaging material spirally about load as dispenser rotates around the ring and the load. In such an embodiment, wrapping ring is vertically movable, and dispenser moves with the ring vertically. The second film guide roller (not shown) may be engaged and disengaged by suitable means.

According to another aspect of the invention, a load support surface may be provided. The load support surface preferably includes a conveyor 160 extending between the first and second legs 152, 154 for transferring the load 124 to and from a wrapping area. As shown in FIG. 8, conveyor 160 includes a plurality of rollers 162 mounted between opposite sides that extend between the first and second legs 152, 154 of the frame 150.

The conveyor 160 moves the load 124 to and from the wrapping area. The load support surface may include an infeed portion for conveying the palletized load to a wrapping portion, a wrapping portion for supporting the load while it is wrapped, and an output portion for conveying the wrapped load 124 away from the wrapping portion. Preferably, the wrapping portion comprises a portion of the conveyor positioned below the bridge 156 and located between the legs 152, 154 of the frame 156. Alternatively, the wrapping portion may not include rollers, and instead may include a flat surface along which the load 124 can slide or be pushed. Also, the wrapping portion may include turntable surface, which may or may not include rollers to move the load.

Figure 10:
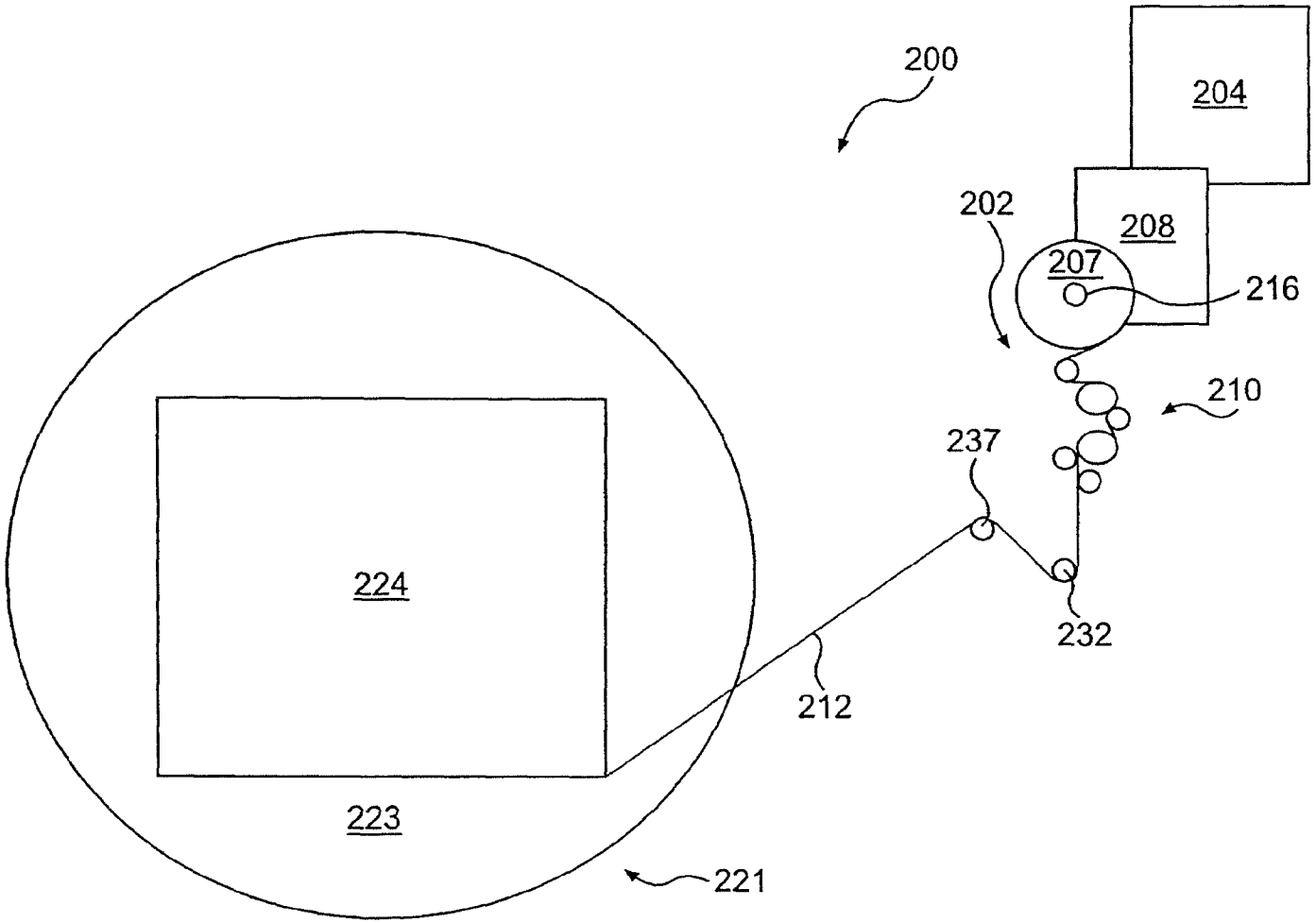
FIG. 10 is a top view of another alternative embodiment of a wrapping apparatus according to an aspect of the invention.

According to another embodiment of the invention, an apparatus 200 may include a packaging material dispenser 202 mounted on a vertical structure such as a stationary mast 204. Packaging material dispenser 202 dispenses a sheet of packaging material 212 in a web form and includes a roll carriage 208 that supports a roll of packaging material 207 on film unwind stand 216. Roll carriage 208 of dispenser 202 is mounted and vertically moveable on mast 204, as shown in FIG. 10. Dispenser 202 moves vertically on mast 204 to dispense packaging material 212 spirally about load 224 as rotation is provided between load 224 and dispenser 202.

Dispenser 202 of apparatus 200 also may include a prestretch portion 210, upstream and downstream guide rollers 232, 237, and at least one roping element, similar to prestretch portion 110, upstream and downstream guide rollers 132, 137, and roping elements 134, 16*a*, 136*b*, previously described with respect to FIGS. 2A-2D, 4A, 4B, 5A, 5B, and 7A-7D.

Apparatus 200 includes means for providing relative rotation between the load 224 and the dispenser 202.

As embodied herein and shown in FIG. 10, the means for providing relative rotation may include a turntable assembly 221 having a rotatable turntable 223. Turntable assembly 221 may be a conventional turntable assembly or may be a low profile turntable assembly, i.e., a turntable that extends about two inches above the floor. Turntable assembly 221 may be positioned proximate a conveyor to receive a load 224 to be wrapped from a load building area. Load 224 is rotated by rotatable turntable 223 of turntable assembly 221 to provide relative motion between dispenser 202 and load 224. Although not shown in the drawings, turntable assembly 221 may include an upper conveying surface with a plurality of powered rollers.

A method of using apparatus 100 to wrap a palletized load according to the present invention will now be described.

According to one aspect of the present invention, a method of wrapping a load using apparatus 100 includes the following. A load 124 on a pallet 126 is placed on a wrapping surface. The wrapping surface may be, for example, the floor or a conveyor 130. The packaging material 112 is pulled from the film roll 107 in the dispenser 102, threaded around first and second prestretch rollers 118, 120, and around upstream and downstream guide rollers 132, 137, and attached to either the load 124 or to a structure adjacent the load. The dispenser 102 is at the lowermost point on rotatable arm 104*a*, with the weight of the dispenser 102 being applied to lever 140, causing downstream guide roller 137 to be in the engaged position. The arm 104 is activated and begins to rotate around the palletized load 124, causing the packaging material 112 to be pulled across first prestretch roller 118, causing first prestretch roller 118 to rotate. Rotation of first prestretch roller 118 is translated to second prestretch roller 120. As the first and second prestretch rollers rotate, the packaging material 112 is precisely elongated between the rollers 118, 120. The film elongation stops when the packaging material 112 reaches the downstream roller 120.

As shown in FIG. 5A, as the packaging material 112 leaves the downstream prestretch roller 120, it engages the upstream guide roller 132 at a first level of elevation A. The upstream guide roller 132 is preferably tilted between about 10 and about 30 degrees away from the film feed direction 103. The first level of elevation A is the elevation at which the film web leaves the film unwind stand 107. The film web engages upstream guide roller 132 and contacts between about 90 degrees and about 180 degrees of the roller surface. The film web 112 is drawn off the upstream guide roller 132 at a second elevation B that is lower than the first elevation A. As the film web 112 leaves the upstream guide roller 132, any film 112 that has slipped down the roller 132 passes over the roping element 136*a*, is compacted, gathered, or compressed, and forms a rope of film 113 along the bottom edge of the web of film 112.

The film web 112 then engages the downstream guide roller 137 at a third level of elevation C. The third level of elevation C may be equal to or lower than the second level of elevation B. The second downstream guide roller 134 is preferably tilted between about 15 and about 45 degrees away from the film feed direction 103 and is also preferably tilted away from the upstream guide roller 132. The film web 112 engages downstream guide roller 137 and contacts between about 90 degrees and about 180 degrees of the roller surface. The film web 112 is drawn off the downstream guide roller 137 at a fourth elevation D that is lower than the third elevation C. As the film web leaves the second downstream guide roller 137 at the fourth elevation D, the film web 112 including roped portion 113, moves over second roping element 136*b*, which pushes the film upward, compacting it to thicken and tighten the roped portion 112*a* along the bottom edge of the web of film 112. In addition, at the fourth elevation D, a lower portion of the film web 112 is at an elevation that is lower than the bottom 124*a* of the load 124 and below the top 126*a* of the pallet 126. As the film web 112 leaves the roller 134 at the fourth elevation D, it is wrapped around the top 126*a* of the pallet 126 and the base 124*a* of the load 124 as shown in FIG. 5A.

As film continues to be dispensed from dispenser 102, dispenser 102 moves vertically on arm 104*a*. As dispenser 102 moves upward on arm 104*a*, the weight of the dispenser 102 is removed from lever 140. When the weight of the dispenser 102 is removed from the lever 140, the lever 140 is released and moves downstream guide roller 137 from the engaged position to the disengaged position. While roller 137 is the disengaged position, the film web 112 does not engage roller 137. Film web 112 travels from upstream guide roller 132 over roping element 136*a* and to the load 124 as the arm 104*a* continues to rotate around the load 124.

Dispenser 102 travels to the top of rotatable arm 104*a* and moves downward again, continuing to dispense packaging material 112. As dispenser 102 approaches the bottom of rotatable arm 104*a*, the weight of the dispenser 102 is applied to lever 140, causing the downstream guide roller 137 to move from the disengaged position to the engaged position. Once in the engaged position, downstream guide roller 137 engages the film web 112 after it leaves upstream guide roller 132 and passes over roping element 136*a*.

The film web 112 then engages the downstream guide roller 137 at the third level of elevation C and contacts between about 90 degrees and about 180 degrees of the roller surface. The film web 112 is drawn off the downstream guide roller 137 at the fourth elevation D, and is wrapped around the top 126*a* of the pallet 126 and the base 124*a* of the load 124.

An alternative method of wrapping a palletized load according to the present invention will now be described.

According to another aspect of the invention, a method of wrapping the load according to the present invention includes the following. A load 124 on a pallet 126 is placed on a wrapping surface. The wrapping surface may be, for example, the floor or a conveyor 160. The packaging material 112 is pulled from the film roll 107 in the dispenser 102, threaded around guide roller 132 and attached to either the load 124 or to a structure adjacent the load. The dispenser 102 is at the lowermost point on rotatable arm 104*a*. The arm 104 is activated and begins to rotate around the palletized load 124, causing the film web 112 to engage the first upstream guide roller 132. In this particular method, the first upstream guide roller 132 may or may not be tilted away from the film feed direction 103, depending upon whether the top of the pallet 126*a* supporting the load 124 is above or below the base of the dispenser 102 when the dispenser is in its lowest position. If the dispenser is not lower than the top of the pallet, then it is desirable to tilt guide roller 132 to drive the film to an elevation below the top of the pallet. Further details will be provided in the alternative methods discussed below. The film web engages guide roller 132 and contacts between about 90 degrees and about 180 degrees of the roller surface. The film web 112 is drawn off the first guide roller 132 and a bottom edge 112*b* of the film web 112 is received in groove 134*a* of cable rolling roper 134, forming a rolled cable 113*a* of film 112 along the bottom edge of the web of film 112. Preferably, at least 3 to 5 inches of the film web 112 is rolled into cable portion 113*a*.

The film web 112 is drawn off the guide roller 132 at an elevation that is lower than the bottom 124*a* of the load 124 and below the top 126*a* of the pallet 126. As the film web 112 leaves the guide roller 132 and cable rolling roper 134, film web 112 and rolled cable 113*a* are wrapped around the top 126*a* of the pallet 126 and the base 124*a* of the load 124 as shown in FIG. 5B, leaving the fork holes in the pallet uncovered with packaging material.

As film continues to be dispensed from dispenser 102, dispenser 102 moves vertically on arm 104*a*. As dispenser 102 moves upward on arm 104*a*, film web 112 travels from first upstream guide roller 132, moves above (i.e., does not engage) cable rolling roper 134 and to the load 124 as the arm 104*a* continues to rotate around the load 124.

Dispenser 102 travels to the top of rotatable arm 104*a*, where a second cable rolling roper 134 may be provided. In such an embodiment, the film web 112 engages guide roller 132 and contacts between about 90 degrees and about 180 degrees of the roller surface. The film web 112 is drawn off the first guide roller 132 and a top edge 112 *a* of the film web 112 is received in groove 134*a* of cable rolling roper 134, forming a rolled cable 113*a* of film 112 along the top edge of the web of film 112. The film web is wrapped around the top of the load 124 as it leaves cable rolling roper 134. Dispenser 102 then moves downward again, continuing to dispense packaging material 112. As dispenser 102 approaches the bottom of rotatable arm 104*a*, the film web 112 is drawn off the guide roller 132, moves over and engages cable rolling roper 134, and film web 112 with rolled cable 113*a* on the bottom portion is wrapped around the top 126*a* of the pallet 126 and the base 124*a* of the load 124 as shown in FIG. 5B.

Alternatively, a second cable rolling roper 134 may be positioned adjacent a top portion of guide roller 132 and move with roller 132 and dispenser 102, such that both the top and bottom of the film web 112 are rolled into cable portions 113*a* during the entire wrapping process. Further, first cable rolling roper 134 may travel with guide roller 132 or may be positioned at a bottom of rotatable arm 104*a*, such that the bottom of the film web 112 is rolled into a cable portion 113*a* when the dispenser is at the bottom of the arm 104*a* and the base of the load is being wrapped.

An alternative method of wrapping a palletized load according to the present invention will now be described.

According to another aspect of the invention, a method of wrapping the load according to the present invention includes the following. A load 124 on a pallet 126 is placed on a wrapping surface. The wrapping surface may be, for example, the floor or a conveyor 160. The packaging material 112 is pulled from the film roll 107 in the dispenser 102, threaded around first and second guide rollers 132, 137 and attached to either the load 124 or to a structure adjacent the load. The dispenser 102 is at the lowermost point on rotatable arm 104*a*, with the weight of the dispenser 102 being applied to lever 140, causing second guide roller 137 to be in the engaged position. The arm 104 is activated and begins to rotate around the palletized load 124, causing the film web 112 to engage the first upstream guide roller 132. In this particular method, the first upstream guide roller 132 may or may not be tilted away from the film feed direction 103, depending upon the position of the dispenser relative to the bottom of the load, as discussed above.

The film web engages guide roller 132 and contacts between about 90 degrees and about 180 degrees of the roller surface. The film web 112 is drawn off the first guide roller 132 and onto cable rolling roper 134, which is positioned immediately adjacent to a bottom portion of guide roller 132. A bottom edge 112*b* of the film web 112 is received in groove 134*a* of cable rolling roper 134, forming a rolled cable 113*a* of film 112 along the bottom edge of the web of film 112. Preferably, 3 to 5 inches of the film web 112 is rolled into cable portion 113*a*. Alternatively, cable rolling roper 134 may be positioned immediately adjacent a top portion of guide roller 132, and a top edge 112*a* of the film may pass through groove 134*a*, forming a rolled cable 113*a* of film 112 along a top edge of the web of film 112.

The film web 112 then engages a second guide roller 137. The second guide roller 137 is preferably tilted between about 15 and about 45 degrees away from the film feed direction 103 and is also preferably tilted away from the first upstream guide roller 132. The film web 112 engages second guide roller 137 and contacts between about 90 degrees and about 180 degrees of the roller surface. As the film web 112 moves around the second guide roller 137, the angled roller pulls downward/outward on the film web 112 as it leaves guide roller 132 to impart a bias to the film web, thereby reducing the width of the portion of the film web 112 not rolled into cable portion 113*a* (see FIG. 11). For example, if the film web 112 has a width of 18 inches after exiting the dispenser (including the prestretch portion, if any), and 5 inches of the film web 112 is rolled into cable 113*a*, 13 inches of the film web remains to engage second guide roller 137. The 13 inch film web 112 and rolled cable portion 113*a* move over roller 137, and as the film web 112 moves over roller 137, the width of the 13 inch film web is narrowed by diagonally biasing the film with roller 137. Biasing the film includes diagonally stretching the film, which narrows the width of the film web 112, as shown in FIGS. 7A and 11. The amount the width of the film web is reduced depends upon the amount of tilt of second guide roller 137. The greater the amount of tilt of the roller 137 (with respect to vertical), the greater the amount of bias on the film and the larger the reduction in the film web width. The width of the portion of the film web 112 not included in rolled cable 113*a* may be reduced between 20% and 75%, and more preferably is reduced may be reduced 25% and 50%. The example shown in FIG. 11 shows a reduction of 38%. The diagonally biased film web 112 with rolled cable portion 113*a* is drawn off the second guide roller 137, it is wrapped around the top 126*a* of the pallet 126 and the base 124*a* of the load 124. This method may also be used when roping elements 136*a*, 136*b* are present instead of cable rolling roper 134.

According to another aspect of the invention, a method of using an apparatus 200 including a turntable assembly 221 will now be described. Dispenser 202 is mounted on a stationary mast 204 and a turntable assembly 221 is provided. In operation, the palletized load 224 is placed on the rotatable surface 223 of the turntable assembly 221, and the film 212 is drawn from the roll 207, wound through the rollers and attached to a clamp (not shown) on the turntable.

As the turntable 223 rotates, dispenser 202 dispenses film 212. The prestretch rollers of the prestretch portion 210 stretch the film as described above with respect to FIG. 5. The upstream and downstream guide rollers 232, 237 engage and move the film 212 downward as described above. As the film 212 is dispensed, dispenser 202 moves vertically along mast 204, first disengaging the downstream guide roller 237 as the dispenser 202 moves upward on mast 204, and later re-engaging the downstream guide roller as the dispenser returns to the bottom of the mast at the end of the wrap cycle. As the downstream guide roller 237 is re-engaged, the film web 212, including a roped bottom portion 213, is wrapped around the base of the load and the top of the pallet as previously discussed.

An alternative method of wrapping a palletized load according to the present invention will now be described. According to another aspect of the invention, a method using apparatus 200 to wrap the load includes the following. A load 224 on a pallet 226 is placed on a rotatable surface 223 of turntable assembly 221. The film web 212 is pulled from the film roll 207 in the dispenser 202, threaded around rollers, and attached to a clamp (not shown) on the turntable. The dispenser 202 is at the lowermost point on stationary mast 204, with the weight of the dispenser 202 being applied to lever 240, causing second guide roller 237 to be in the engaged position. As the turntable rotates, dispenser 202 dispenses film web 212. The prestretch rollers of prestretch portion 210 stretch the film as described above with respect to FIG. 3.

As the film web 212 leaves the downstream prestretch roller, it engages the first upstream guide roller 232 at a first level of elevation A. The first upstream guide roller 232 is preferably tilted between about 10 and about 30 degrees away from the film feed direction 203. The first level of elevation A is the elevation at which the film web 212 leaves the film unwind stand 207. The film web 212 engages guide roller 232 and contacts between about 90 degrees and about 180 degrees of the roller surface. The film web 212 is drawn off the first guide roller 232 at a second elevation B that is may be equal to or lower than the first elevation A. If guide roller 232 is not tilted, elevation A and elevation B should be approximately the same. The more guide roller 232 is tilted with respect to the vertical, the greater the difference between elevation A and elevation B. As the film web 212 leaves the first guide roller 232, any film 212 that has slipped down the guide roller 232 moves over the cable rolling roper 234 and is rolled into cable portion 213*a* at the bottom of the film web 212.

The film web 212 then engages the second guide roller 237 at a third level of elevation C. The third level of elevation C may be approximately equal to or lower than the second level of elevation B (and also approximately equal to elevation A if first guide roller 232 is not tilted). The second guide roller 237 is preferably tilted between about 15 and about 45 degrees away from the film feed direction 203 and is also preferably tilted away from the first upstream guide roller 232. The film web 212 engages second guide roller 237 and contacts between about 90 degrees and about 180 degrees of the roller surface. The film web 212 is drawn off the second guide roller 237 at a fourth elevation D that is lower than the third elevation C. As the film web 212 leaves the second guide roller 237 at the fourth elevation D, the film web 212 including rolled cable portion 213*a* moves toward the load 224. In addition, at the fourth elevation D, a lower portion of the film web 212 is at an elevation that is lower than the bottom 224*a* of the load 224 and below the top 226*a* of the pallet 226. As film web 212 with rolled cable portion 236 leaves the second guide roller 237 at the fourth elevation D, it is wrapped around the top 226*a* of the pallet 226 and the base 224*a* of the load 224.

As film web 212 continues to be dispensed from dispenser 202, dispenser 202 moves vertically on mast 204. As dispenser 202 moves upward on mast 204, the weight of the dispenser 202 is removed from lever 240. When the weight of the dispenser 202 is removed from the lever 240, the lever 240 is released and moves second guide roller 237 from the engaged position to the disengaged position. While second guide roller 237 is the disengaged position, the film web 212 does not engage second guide roller 237. Film web 212 travels from first upstream guide roller 232 over roping element 236 and to the load 224 as the turntable continues to rotate the load 224 and dispenser 202 moves upward on mast 204.

Dispenser 202 travels to the top of mast 204, where a second cable rolling roper 234 may be provided. In such an embodiment, the film web 212 engages guide roller 232 and contacts between about 90 degrees and about 180 degrees of the roller surface. The film web 212 is drawn off the first guide roller 232 and a top edge 212*a* of the film web 212 is received in groove 234*a* of cable rolling roper 234, forming a rolled cable 213*a* of film 212 along the top edge of the web of film 212. The film web 212 with rolled cable 213*a* is wrapped around the top of the load 224 as it leaves cable rolling roper 234.

As dispenser 202 approaches the bottom of mast 204, the weight of the dispenser 202 is applied to lever 240, causing the second guide roller 237 to move from the disengaged position to the engaged position. Once in the engaged position, second guide roller 237 engages the film web 212 after it leaves upstream guide roller 232 and moves over cable rolling roper 234.

The film web 212 then engages the second guide roller 237 at the third level of elevation C and contacts between about 90 degrees and about 180 degrees of the roller surface. The film web 212 is drawn off the second guide roller 237 at the fourth elevation D, and is wrapped around the top 226*a* of the pallet 226 and the base 224*a* of the load 224.

Alternatively, a second cable rolling roper 234 may be positioned adjacent a top portion of guide roller 232 and move with roller 232 and dispenser 202, such that both the top and bottom of the film web 212 are rolled into cable portions 213*a* during the entire wrapping process. Further, first cable rolling roper 234 may travel with guide roller 232 or may be positioned at a bottom of mast 204, such that the bottom of the film web 212 is rolled into a cable portion 213*a* when the dispenser is at the bottom of the mast 204 and the base of the load is being wrapped.

According to another aspect of the invention, a method using apparatus 200 to wrap the load includes the following. A load 224 on a pallet 226 is placed on a rotatable surface 223 of turntable assembly 221. The film web 212 is pulled from the film roll 207 in the dispenser 202, threaded around rollers, and attached to a clamp (not shown) on the turntable. The dispenser 202 is at the lowermost point on stationary mast 204. The turntable assembly 221 begins to rotate, causing the film web 212 to engage the first upstream guide roller 232. In this particular method, the first upstream guide roller 232 may or may not be tilted away from the film feed direction 203, depending upon whether the top of the pallet 226*a* supporting the load 224 is above or below the base of the dispenser 202 when the dispenser is in its lowest position. If the dispenser is not lower than the top of the pallet, then it is desirable to tilt guide roller 232 to drive the film to an elevation below the top of the pallet.

The film web engages guide roller 232 and contacts between about 90 degrees and about 180 degrees of the roller surface. The film web 212 is drawn off the first guide roller 232 and a bottom edge 212*b* of the film web 212 is received in groove 234*a* of cable rolling roper 234, forming a rolled cable 213*a* of film 212 along the bottom edge of the web of film 212. Preferably, at least 3 to 5 inches of the film web 212 is rolled into cable portion 213*a*.

The film web 212 is drawn off the guide roller 232 at an elevation that is lower than the bottom 224*a* of the load 224 and below the top 226*a* of the pallet 226. As the film web 212 leaves the guide roller 232 and cable rolling roper 234, film web 212 and rolled cable 213*a* are wrapped around the top 226*a* of the pallet 226 and the base 224*a* of the load 224, leaving the fork holes in the pallet 226 uncovered with packaging material 212.

As film web 212 continues to be dispensed from dispenser 202, dispenser 202 moves vertically on mast 204. As dispenser 202 moves upward on mast 204, film web 212 travels from first upstream guide roller 232, moves above (i.e., does not engage) cable rolling roper 234 and to the load 224 as the turntable 223 continues to rotate the load 224.

Dispenser 202 travels to the top of mast 204, where a second cable rolling roper 234 may be provided as previously discussed. Dispenser 202 then moves downward again, continuing to dispense film web 212. As dispenser 202 approaches the bottom of mast 204, the film web 212 is drawn off the guide roller 232, moves over and engages cable rolling roper 234, and film web 212 with rolled cable 213*a* on the bottom portion is wrapped around the top 226*a* of the pallet 226 and the base 224*a* of the load 224.

Alternatively, a second cable rolling roper 234 may be positioned adjacent a top portion of guide roller 232 and move with roller 232 and dispenser 202, as previously discussed. Further, first cable rolling roper 234 may travel with guide roller 232 or may be positioned at a bottom of mast 204.

According to another aspect of the invention, a method using apparatus 200 to wrap the load includes the following. A load 224 on a pallet 226 is placed on a rotatable surface 223 of turntable assembly 221. The film web 212 is pulled from the film roll 207 in the dispenser 202, threaded around rollers, and attached to a clamp (not shown) on the turntable. The dispenser 202 is at the lowermost point on stationary mast 204, with the weight of the dispenser 202 being applied to lever 240, causing second guide roller 237 to be in the engaged position. As the turntable rotates, dispenser 202 dispenses film web 212.

As the turntable assembly 221 rotates, film web 212 is dispensed and engages guide roller 232, contacting between about 90 degrees and about 180 degrees of the roller surface. The film web 212 is drawn off the first guide roller 232 and onto cable rolling roper 234, which is positioned immediately adjacent to a bottom portion of guide roller 232. A bottom edge 212*b* of the film web 212 is received in groove 234*a* of cable rolling roper 234, forming a rolled cable 213*a* of film 212 along the bottom edge of the web of film 212. Preferably, 3 to 5 inches of the film web 212 is rolled into cable portion 213*a*. Alternatively, cable rolling roper 234 may be positioned immediately adjacent a top portion of guide roller 232, and a top edge 212*a* of the film may pass through groove 234*a*, forming a rolled cable 213*a* of film 212 along a top edge of the web of film 212.

The film web 212 then engages a second guide roller 237. The second guide roller 237 is preferably tilted between about 15 and about 45 degrees away from the film feed direction 203 and is also preferably tilted away from the first upstream guide roller 232. The film web 212 engages second guide roller 237 and contacts between about 90 degrees and about 180 degrees of the roller surface. As the film web 212 moves around the second guide roller 237, the angle of the roller imparts a bias to the film web, reducing the width of the portion of the film web 212 not rolled into cable portion 213*a*. The diagonally biased film web 212 with rolled cable portion 213*a* is drawn off the second guide roller 237, it is wrapped around the top 226*a* of the pallet 226 and the base 224*a* of the load 224.

According to another aspect of the invention, a further alternative method of using an apparatus 200 including a turntable assembly 221 will now be described. Dispenser 202 is mounted on a stationary mast 204 and a turntable assembly 221 is provided. In operation, the palletized load 224 is placed on the rotatable surface 223 of the turntable assembly 221, and the film 212 is drawn from the roll 207, wound through the rollers and attached to a clamp (not shown) on the turntable.

As the turntable 223 rotates, dispenser 202 dispenses film web 212. The prestretch rollers of the prestretch portion 210 stretch the film as described above with respect to FIG. 5. The guide rollers 232, 237 engage and move the film web 212 downward as described above. As the film 212 is dispensed, dispenser 202 moves vertically along mast 204, first disengaging the second downstream guide roller 237 as the dispenser 202 moves upward on mast 204, and later re-engaging the second downstream guide roller 237 as the dispenser returns to the bottom of the mast at the end of the wrap cycle. As the second guide roller 237 is re-engaged, the film web 212, including a rolled cable portion 213*a* forming at least one of the top and bottom portions of the film web 212, is wrapped around the base of the load and the top of the pallet as previously discussed with respect to FIG. 11.

Other embodiments of the invention will be apparent to those skilled in the art from consideration of the specification and practice of the invention disclosed herein. It is intended that the specification and examples be considered as exemplary only, with a true scope and spirit of the invention being indicated by the following claims.

The invention claimed is:

1. An apparatus for wrapping a load, comprising:

a dispenser for dispensing a film web;

a first roller engaging at least a portion of a width of the film web;

at least one roping element to form a cable from a portion of the film web; and a second guide roller engaging at least a portion of the width of the film web, the second guide roller being movable into a first and a second position, the second position a tilted drive down position to drive down the film web from a first elevation to a second elevation through rotation of the second guide roller, the second elevation lower than the first elevation, the first position a non-drive down position.

2. The apparatus of claim 1 further including a motor to provide rotation of the load relative to the dispenser.

3. The apparatus of claim 2 wherein the dispenser is on a rotatable arm.

4. The apparatus of claim 2 wherein the dispenser is on a ring.

5. The apparatus of claim 2, wherein the first roller is tilted towards a direction of travel of the film web.

6. The apparatus of claim 2, wherein the at least one roping element is a cable rolling roper to roll a portion of the film web into a cable.

7. The apparatus of claim 2, wherein the at least one roping element is positioned downstream of the first roller.

8. The apparatus of claim 7, wherein the second guide roller is downstream of the first roller.

9. The apparatus of claim 2, further comprising a second roping element.

10. The apparatus of claim 2, wherein the first roping element is positioned downstream of the first roller and a second roping element positioned downstream of the second guide roller.

11. The apparatus ot claim 2, wherein at least one of the first roller and second guide roller are tiltable relative to each other.

12. The apparatus of claim 2, wherein the second guide roller is tiltable in the drive down position in a direction of travel of the film web to drive down a portion of a roped film web at a first vertical position to about an elevation of a bottom edge of non-roped film whendispensed in the first vertical position.

13. The apparatus for wrapping a load of claim 2 wherein the roping element travels vertically with the first roller.

14. The apparatus for wrapping a load of claim 2 wherein the roping element and the second guide roller are connected to a lever, the lever positioning the second guide roller in the tilted drive down position and positioning the roping element against a lower edge of the film web.

15. The apparatus for wrapping a load of claim 2 wherein the dispenser travels vertically on a mast.

16. The apparatus of claim 1, wherein the roping element is a roller and includes a circumferential groove for receiving and rolling an edge of the film web.

17. The apparatus of claim 1, wherein the roping element is positioned to roll a portion of the film web into a cable.

18. The apparatus of claim 1, wherein the roping element is positioned to roll a bottom portion of the film web into a cable.

19. The apparatus of claim 1 wherein the second guide roller in the non-drive down position engages the film web.

20. An apparatus for wrapping a load, comprising:

a dispenser for dispensing a film web;

a first roller engaging at least a portion of a width of the film web;

at least one roping element movable into the film web to create a cable which retains its structural integrity during the wrapping process; and a second guide roller being movable between a first and a second position, the second guide roller engaging at least a portion of the width of the film web, the second position a tilted drive down position, the second guide roller rotatable to drive down the elevation of the film web in the second position from a first elevation to a second elevation lower than the first elevation, the first position of the second guide roller being a non-drive down position.

21. An apparatus for wrapping a load, comprising:

a dispenser for dispensing a film web;

a roping element to form a portion of the film web into a cable, the cable retaining its structural integrity during the wrapping process;

a rotatable drive down guide roller engaging at least a portion of the width of the film web;

wherein the rotatable drive down guide roller is movable between a first and a second position, the first position a tilted drive down position to drive down at least a portion of the film web from a first elevation to a second elevation lower than the first elevation through rotation of the drive down guide roller; and wherein the second position of the drive down guide roller is a non-drive down position.

* * * * *